US006871941B2

(12) United States Patent
Horii et al.

(10) Patent No.: US 6,871,941 B2
(45) Date of Patent: Mar. 29, 2005

(54) PRINT HEAD, MANUFACTURING METHOD THEREFOR, AND PRINTER

(75) Inventors: Shinichi Horii, Kanagawa (JP); Shigeyoshi Hirashima, Kanagawa (JP); Atsushi Nakamura, Kanagawa (JP); Shinji Kayaba, Tokyo (JP); Makoto Ando, Tokyo (JP); Hiroshi Tokunaga, Tokyo (JP); Takaaki Murakami, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/614,586

(22) Filed: Jul. 7, 2003

(65) Prior Publication Data

US 2004/0021735 A1 Feb. 5, 2004

Related U.S. Application Data

(63) Continuation of application No. 09/925,154, filed on Aug. 8, 2001, now Pat. No. 6,663,223.

(30) Foreign Application Priority Data

| | | |
|---|---|---|
| Aug. 9, 2000 | (JP) | P2000-240841 |
| Aug. 18, 2000 | (JP) | P2000-248435 |
| Sep. 12, 2000 | (JP) | P2000-276554 |
| May 9, 2001 | (JP) | P2001-138431 |
| Jul. 17, 2001 | (JP) | P2001-216402 |

(51) Int. Cl.[7] ..... B41J 2/16; B41J 2/155; B41J 2/015

(52) U.S. Cl. ..... 347/48; 347/42; 347/20

(58) Field of Search ..... 347/48, 42, 20

(56) References Cited

U.S. PATENT DOCUMENTS 6,447,984 B1 * 9/2002 Tatsumi et al. ..... 430/320

FOREIGN PATENT DOCUMENTS

JP 02000263768 A * 9/2000 ..... B41J/2/01

* cited by examiner

*Primary Examiner*—Stephen D. Meler
*Assistant Examiner*—Alfred Dudding
(74) *Attorney, Agent, or Firm*—Sonnenschein, Nath & Rosenthal LLP

(57) ABSTRACT

A print head is provided with at least ink-pressurizing cells, heating elements, and ink-ejection nozzles. In addition, the print head includes substrate members which form side surfaces and one end surface of the ink-pressurizing cells, and which are provided with the heating elements; a nozzle-formed member which forms the other end surface of the ink-pressurizing cells, and in which the ink-ejection nozzles, which individually correspond to the ink-pressurizing cells, are formed; and a head frame which supports the nozzle-formed member.

4 Claims, 32 Drawing Sheets

PRINT HEAD, MANUFACTURING METHOD THEREFOR, AND PRINTER

RELATED APPLICATION DATA

The present application claims priority to Japanese Application Nos. P2000-240841 filed Aug. 9, 2000, P2000-248435 filed Aug. 18, 2000, P2000-276554 filed Sep. 12, 2000, P2001-138431 filed May 9, 2001 and P2001-216402 filed Jul. 17, 2001, and is a continuation of U.S. application Ser. No. 09/925,154, filed Aug. 8, 2001 now U.S. Pat. No. 6,663,223, all of which are incorporated herein by reference to the extent permitted by law.

BACKGROUND OF THE INVENTION

1. Field of the Invention

The present invention relates to a new print head, a manufacturing method therefore, and a printer.

2. Description of the Related Art

Conventionally, such print heads are known in which ink-pressurizing cells, which are individually provided with heating elements, are covered by a nozzle-formed member, in which small ink-ejection nozzles are formed. When the heating elements are rapidly heated, bubbles of ink vapor (ink bubbles) are generated, and ink drops are ejected from the ink-ejection nozzles due to pressures applied by the ink bubbles.

Such a print head normally has a construction shown in FIGS. 34 and 35.

A print head a includes a substrate member d which is provided with heating elements c and which defines side surfaces and one end surface of ink-pressurizing cells b. The substrate member d is constructed by forming the heating elements c on a surface of a semiconductor substrate e formed of silicon, etc., and laminating a barrier layer f on the semiconductor substrate e at the same side as the side at which the heating elements c are deposited. The barrier layer f defines side surfaces of the ink-pressurizing cells b; in other words, it serves as side walls of the ink-pressurizing cells b. The barrier layer f is formed of, for example, a dry film which is curable by light exposure, and is constructed by laminating the dry film over the entire surface of the semiconductor substrate e, on which the heating elements c are formed, and removing unnecessary parts by a photolithography process. Accordingly, the substrate d is completed.

Then, a nozzle-formed member g is laminated on the barrier layer f of the substrate member d. The nozzle-formed member g is provided with ink-ejection nozzles h, which are aligned relative to the heating elements c formed on the substrate member d.

Accordingly, the ink-pressurizing cells b, of which end surfaces are defined by the substrate member d and the nozzle-formed member g, and side surfaces are defined by the barrier layer f, are formed. The ink-pressurizing cells b are linked with an ink passage i, and are provided with the ink-ejection nozzles h which oppose the heating elements c. The heating elements c in the ink-pressurizing cells b are electrically connected to an external circuit via conductors (not shown) deposited on the semiconductor substrate e.

Normally, a single print head includes hundreds of heating elements c and ink-pressurizing cells b containing the heating elements c. The heating elements c are selectively heated in accordance with a command issued by a control unit of a printer, and ink drops are ejected from the corresponding ink-ejection nozzles h.

In the print head a, the ink-pressurizing cells b are filled with ink supplied via the ink passage i from an ink tank (not shown) which is combined with the print head a. When a current pulse is applied to one of the heating elements c for a short time such as 1 to 3 $\mu$s, the heating element c is rapidly heated, and a bubble of ink vapor (ink bubble) is generated at the surface thereof. Then, when the ink bubble expands, a certain volume of ink is pushed ahead, and the same volume of ink is ejected out from the corresponding ink-ejection nozzle h as an ink drop. The ink drop, which is ejected from the ink-ejection nozzle h, adheres (lands on) to a print medium such as a piece of paper, etc.

The above-described print head a is usually used for a serial head which includes a plurality of head chips. A single head chip is formed by laminating a single substrate member, in which a plurality of ink-pressurizing cells and heating elements are formed, on a single nozzle-formed member, and a plurality of head chips are arranged in a direction perpendicular to the feed direction of the print medium.

When the print head a is used, it is moved in the direction perpendicular to the feed direction of the print medium and prints a line. Then, the print medium is moved in the feed direction and the next line is printed.

In the above-described print head a, characteristics of ink drop ejection are affected by positional relationships between the heating elements c (the ink-pressurizing cells b) and the ink-ejection nozzles h. When the heating elements c (the ink-pressurizing cells b) and the ink-ejection nozzles h are greatly displaced, the ejection speed may be reduced and the ejecting direction may be changed. Furthermore, it may even be impossible to eject ink drops. Accordingly, displacements between the heating elements c (the ink-pressurizing cells b) and the ink-ejection nozzles h lead to a degradation of the printing quality, and thus are a large problem.

Generally, heating processes are necessary for manufacturing the print head a. For example, after the barrier layer f is formed on the semiconductor substrate e and the nozzle-formed member g is laminated on the barrier layer f, a heat curing process for curing the barrier layer f and fixing the nozzle-formed member g is performed at a high temperature. In addition, another high-temperature curing process is performed to provide ink resistance to the barrier layer f, which is formed of dry film resist.

As described above, heating processes are necessary for manufacturing a print head. Coefficient of linear expansion of silicon, which is normally used for forming the semiconductor substrate e, is $2.6\times10^{-6}$, and that of nickel, which is normally used for forming the nozzle-formed member g, is $13.4\times10^{-6}$. Accordingly, the coefficients of linear expansion of silicon and nickel differ by approximately one order of magnitude.

When two materials having extremely different coefficients of linear expansion are laminated together in a heating process, relative displacement occurs due to the difference in shrinkage rates. Such a displacement varies in accordance with the difference in the coefficients of linear expansion between the members that are laminated together, and is increased as the difference becomes larger.

With reference to FIG. 36, at position (a), the heating element c (the ink-pressurizing cell b) and the ink-ejection nozzle h are aligned. However, at position (b), which is apart from position (a), the ink-ejection nozzle h is displaced relative to the heating element c (the ink-pressurizing cell b), and at position (c), which is farther apart from position (a), the ink-ejection nozzle h is completely displaced, even from the ink-pressurizing cell b. Such a displacement increases along with the size of the members which are laminated together. When the heating element c (the ink-pressurizing cell b) and the ink-ejection nozzle h are displaced relative to each other (see FIG. 36, position (b)), the ejecting direction is changed. In addition, when the displacement therebetween is increased still further (see FIG. 36, position (c)), it becomes impossible to eject ink.

In the printer market, it is required to increase the printing speed, and one approach to satisfy this requirement is to increase the number of nozzles from which ink is ejected. When the resolution of a printer is maintained and the number of nozzles is increased, the size of a print head is also increased. Thus, the influence of the displacements between the heating elements c (the ink-pressurizing cells b) and the ink-ejection nozzles h, which occur due to the difference in coefficients of linear expansion, is also increased. In addition, in large print heads such as line heads, etc., there is a large problem in that the displacements between the heating elements c (the ink-pressurizing cells b) and the ink-ejection nozzles h become relatively large.

In addition, the conventional print head includes a plurality of head chips that are individually constructed, and the ink passages and the nozzle-formed members contained in the head chips are separately installed. Accordingly, the conventional print head has a complex structure for supplying each of the head chips with ink.

Furthermore, since a single head chip is constructed on a single nozzle-formed member, the printing characteristics are degraded due to the dimensional errors of the head chips, displacements of the head chips which occur when the head chips are arranged, etc.

Short length of the head chips is another cause of the degradation of the printing characteristics.

Since the head chips are manufactured by forming heating elements on a semiconductor substrate, that is, on a circular semiconductor wafer, it is difficult to form long substrate members. When the length of the substrate members is increased, yield is reduced and manufacturing cost is increased. Accordingly, it is difficult to increase the length of the substrate members. However, when the heating elements are formed on the substrate members having a short length, it is difficult to make sizes, thicknesses, etc., of the heating elements formed in the different substrate members the same.

As a result, when a plurality of head chips are arranged, the characteristics of ink drop ejection, and more specifically, the size of the ink drops, cannot be made uniform at all of the head chips.

When such head chips are merely arranged on one line, images printed by the adjacent head chips appear differently. Accordingly, there is a problem in which print mottling occurs.

SUMMARY OF THE INVENTION

In order to solve the above-described problems, according to one aspect of the present invention, a print head includes a substrate member which forms side surfaces and one end surface of the ink-pressurizing cells, and which is provided with the heating elements; a nozzle-formed member which forms the other end surface of the ink-pressurizing cells, and in which the ink-ejection nozzles, which individually correspond to the ink-pressurizing cells, are formed; and a head frame which supports the nozzle-formed member.

Thus, the nozzle-formed member is supported by the head frame, and the interval between the ink-ejection nozzles formed in the nozzle-formed member extends and shrinks along with the head frame. Accordingly, by making the coefficient of linear expansion of the head frame closer to that of the substrate member, the displacements between the heating elements (the ink-pressurizing cells) and the ink-ejection nozzles can be made zero, or can be reduced to an extremely small amount.

According to another aspect of the present invention, a manufacturing method for a print head, in which a substrate member, which forms side surfaces and one end surface of ink-pressurizing cells and which is provided with heating elements, is laminated at a high temperature on a nozzle-formed member, which forms the other end surface of the ink-pressurizing cells and in which the ink-ejection nozzles, which individually correspond to the ink-pressurizing cells, are formed, includes the steps of laminating the nozzle-formed member on a head frame, which has the same coefficient of linear expansion as the substrate member, at a temperature $T_1$, which is higher than room temperature; and laminating the substrate member on the nozzle-formed member at a temperature $T_2$, which is higher than room temperature. The temperature $T_1$ is higher than the temperature $T_2$.

Thus, the nozzle-formed member is more shrunk at the step of laminating the substrate member on the nozzle-formed member than at the step of laminating the nozzle-formed member on the head frame. The nozzle-formed member shrinks-along with the head frame at the same shrinkage rate, and the head frame has the same coefficient of linear expansion as the substrate member. Accordingly, when the interval between the heating elements (the ink-pressurizing cells) and the interval between the ink ejection-nozzle are designed to become the same at temperature $T_2$, at which the substrate member is laminated on the nozzle-formed member, the displacements between the heating elements (the ink-pressurizing cells) and the ink-ejection nozzles can be made small.

According to another aspect of the present invention, a print head having at least ink-pressurizing cells, heating elements, and ink-ejection nozzles, includes a plurality of substrate members, each of which forms side-surfaces and one end surface of the ink-pressurizing cells, and which is provided with the heating elements; and a nozzle-formed member which forms the other end surface of the ink-pressurizing cells, and in which the ink-ejection nozzles, which individually correspond to the ink-pressurizing cells, are formed. The substrate members are provided with the ink-pressurizing cells and the heating elements which individually correspond to the ink-pressurizing cells, and a plurality of head chips are constructed by laminating the substrate members on a common nozzle-formed member in such a manner that the ink-ejection nozzles individually correspond to the ink-pressurizing cells. The head chips are arranged in a direction perpendicular to a feed direction of a print medium in a zigzag manner so that end portions of the head chips overlap one another in the longitudinal direction thereof, and in such a manner that the ink inlets of the ink pressurizing cells of the head chips oppose one another, and a common ink passage is formed between the head chips which oppose one another.

Thus, a plurality of head chips are constructed on a single, common nozzle-formed member. Accordingly, the positional accuracy of the ink-ejection nozzles can be improved, and print mottling can be made less conspicuous by arranging the head chips in a zigzag manner so that end portions thereof overlap one another.

In addition, since a single ink passage is connected to a plurality of head chips, the structure for supplying ink to each of the head chips can be made simpler.

According to another aspect of the present invention, a print head includes a substrate member and a nozzle-formed member which have approximately the same coefficient of linear expansion.

Accordingly, in the print head according to the present invention, displacements between the heating elements and the ink-ejection nozzles, and between the ink-pressurizing cells and the ink-ejection nozzles, which occur due to the difference in coefficients of linear expansion between the substrate member and the nozzle-formed member, can be reduced. In addition, degradation of durability due to the increase of temperature during the operation can be suppressed.

According to another aspect of the present invention, a print head includes a warp-suppressing member which has approximately the same coefficient of linear expansion as the nozzle-formed member, and which is laminated on the frame member at the side opposite to the side at which the nozzle-formed member is laminated.

Thus, due to the warp-suppressing member, the frame member also receives tension at the side opposite to the side at which the nozzle-formed member is laminated.

According to another aspect of the present invention, in order to prevent the lamination surface of the frame member from warping, a manufacturing method for a print head includes the steps of forming a lamination surface of the frame member, on which the nozzle-formed member is to be laminated, in the shape of a curved surface in advance; and laminating the nozzle-formed member on the lamination surface at a high temperature, so that the frame member deforms at an operating temperature due to a difference in coefficients of linear expansion between the frame member and the nozzle-formed member in such a manner that the lamination-surface of the frame member becomes flat.

Thus, the lamination surface becomes flat at the operating temperature.

According to another aspect of the present invention, in order to avoid the problem which occurs due to the warping of the lamination surface of the frame member, intervals between the heating elements, between the ink-pressurizing cells, and between the ink-ejection nozzles are increased from a central portion toward a peripheral portion.

Thus, intervals between landing points of the ink drops become uniform, and degradation of the printing quality due to nonuniformity of the intervals between the landing points can be avoided.

According to another aspect of the present invention, in order to avoid the problem which occurs due to the warping of the lamination surface of the frame member, a control method for a print head includes the step of adjusting the time to apply current to the heating elements such that the heating elements positioned closer to the central portion receive current earlier than the heating elements positioned closer to the peripheral portion.

Thus, the time to apply current to the heating elements positioned closer to the central portion, at which the travel distances of the ink drops are made longer due to the warping of the lamination surface of the-frame member, is made earlier. Accordingly, landing time of the ink drops on the print medium is made the same over the entire region.

According to another aspect of the present invention, a print head having at least ink-pressurizing cells, heating elements, and ink-ejection nozzles, includes a plurality of substrate members which forms side surfaces and one end surface of the ink-pressurizing cells, and which are provided with the heating elements; a nozzle-formed member which forms the other end surface of the ink-pressurizing cells, and in which the ink-ejection nozzles, which individually correspond to the ink-pressurizing cells, are formed; a head frame which supports the nozzle-formed member; and a plurality of head chips which are constructed by laminating the substrate members on a common nozzle-formed member in such a manner that the ink-ejection nozzles individually correspond to the ink-pressurizing cells. The head chips are arranged in a direction perpendicular to a feed direction of a print medium, and the head frame is provided with head-chip-receiving holes which individually receive the head chips.

Thus, the nozzle-formed member is supported by the head frame, and the interval between the ink-ejection nozzles formed in the nozzle-formed member extends and shrinks along with the head frame. Accordingly, by making the coefficient of linear expansion of the head frame closer to that of the substrate member, the displacements between the heating elements (the ink-pressurizing cells) and the ink-ejection nozzles can be made zero, or can be reduced to an extremely small amount. In addition, since a plurality of head-chip-receiving holes which individually receive the head chips are formed in the head frame, the rigidity of the head frame is increased in the longitudinal direction thereof. Accordingly, a print head having high rigidity, which is especially suitable as a line head, can be obtained.

DESCRIPTION OF THE PREFERRED EMBODIMENTS

Figure 1:
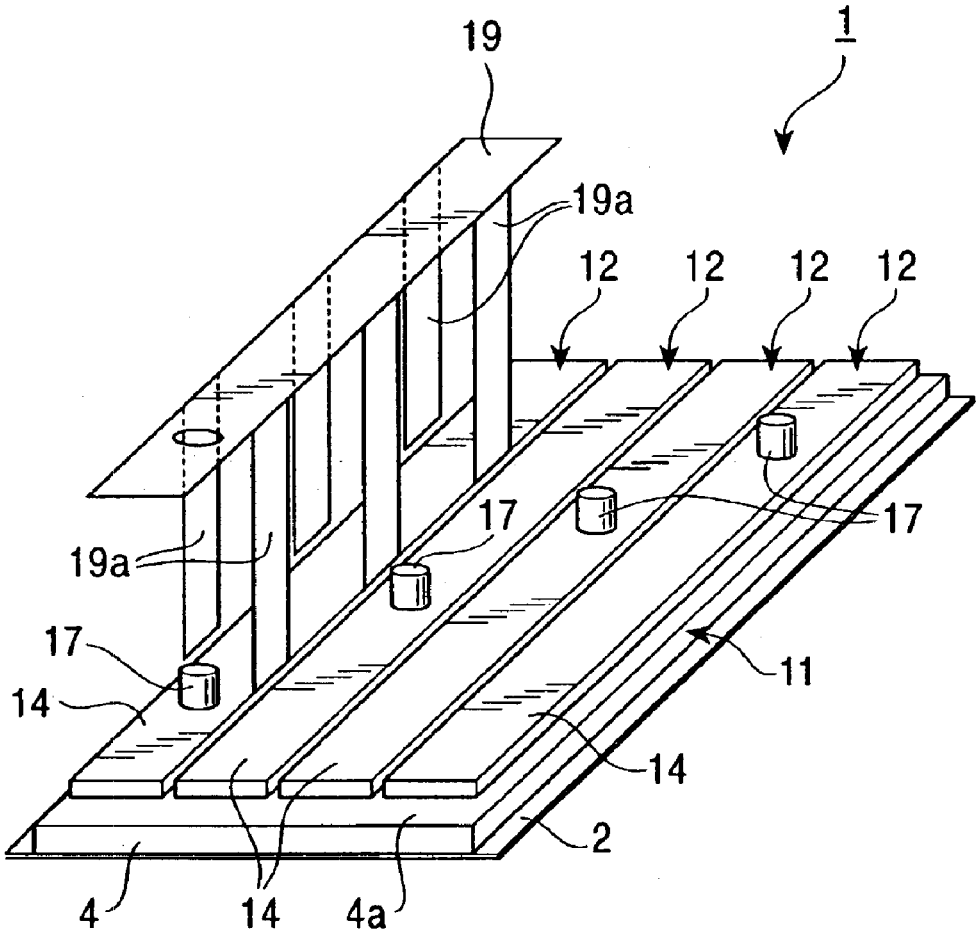
FIG. 1 is a perspective view of a print head according to a first embodiment of the present invention.

Embodiments of the present invention will be described below with reference to the accompanying drawings.

A print head 1 according to a first embodiment is a print head for a full-color, bubble ink jet printer.

The print head 1 includes a nozzle-formed member 2, in which a plurality of ink-ejection nozzles 3 are formed. Several hundred ink-ejection nozzles 3 are formed in a single substrate member, which will be described below. The nozzle-formed member 2 is formed of nickel or a material comprising nickel in the shape of, for example, a sheet having a thickness of 15 to 20 $\mu$m by an electroforming technique. The ink-ejection nozzles 3 having a diameter of approximately 20 $\mu$m are formed in the nozzle-formed member 2 (see FIGS. 2 and 3). When nickel or a material comprising nickel is used as the material for forming the nozzle-formed member 2, the nozzle-formed member 2 in which the ink-ejection nozzles 3 are positioned with high accuracy can be obtained with a relatively low cost.

The nozzle-formed member 2 is laminated to a head frame 4. The head frame 4 includes an outside frame portion 4*a* having a rectangular shape and three bridge portions 4*b* which are integrally formed with the outside frame portion 4*a* and which link the lateral sides of the outside frame portion 4*a* at a constant interval. Accordingly, four openings 5 having a rectangular shape are formed in parallel to each other (see FIG. 2). In the case in which the print head 1 is applied to a line printer which prints on 'A4' sized paper in a portrait orientation, the length of the openings 5 corresponds to the width of the size 'A4', that is, 21 cm.

The head frame 4 is formed of a material having the same coefficient of linear expansion as a semiconductor substrate of the substrate member, 6 which will be described below. When, for example, a silicon substrate is used as the semiconductor substrate, silicon nitride is used for forming the head frame 4. Alternatively, alumina (Al2O3), mullite, aluminum nitride, silicon carbide, etc., may be used from the group of ceramics, quartz (SiO2), etc., may be used from the group of glass, and INVAR, etc., may be used from the group of metals.

The head frame 4 may have a thickness of, for example, 5 mm, and is sufficiently rigid. When the head frame 4 is laminated on the nozzle-formed member 2 at a high temperature such as 150° C., the nozzle-formed member 2 tries to shrink by a larger amount than the head frame 4 at a temperature lower than the laminating temperature (150° C.), and thus becomes tense. Since the head frame 4 is sufficiently rigid, the interval between the ink-ejection nozzles 3, that is, a nozzle interval, varies in accordance with the coefficient of linear expansion of the head frame 4. The head frame 4 is laminated on the nozzle-formed member 2 by using, for example, a heat-setting adhesive sheet.

A plurality of head chips HC are formed by laminating substrate members 6 on the nozzle-formed member 2. Accordingly, a plurality of head chips HC are formed on a single nozzle-formed member 2 (see FIG. 2).

Figure 3:
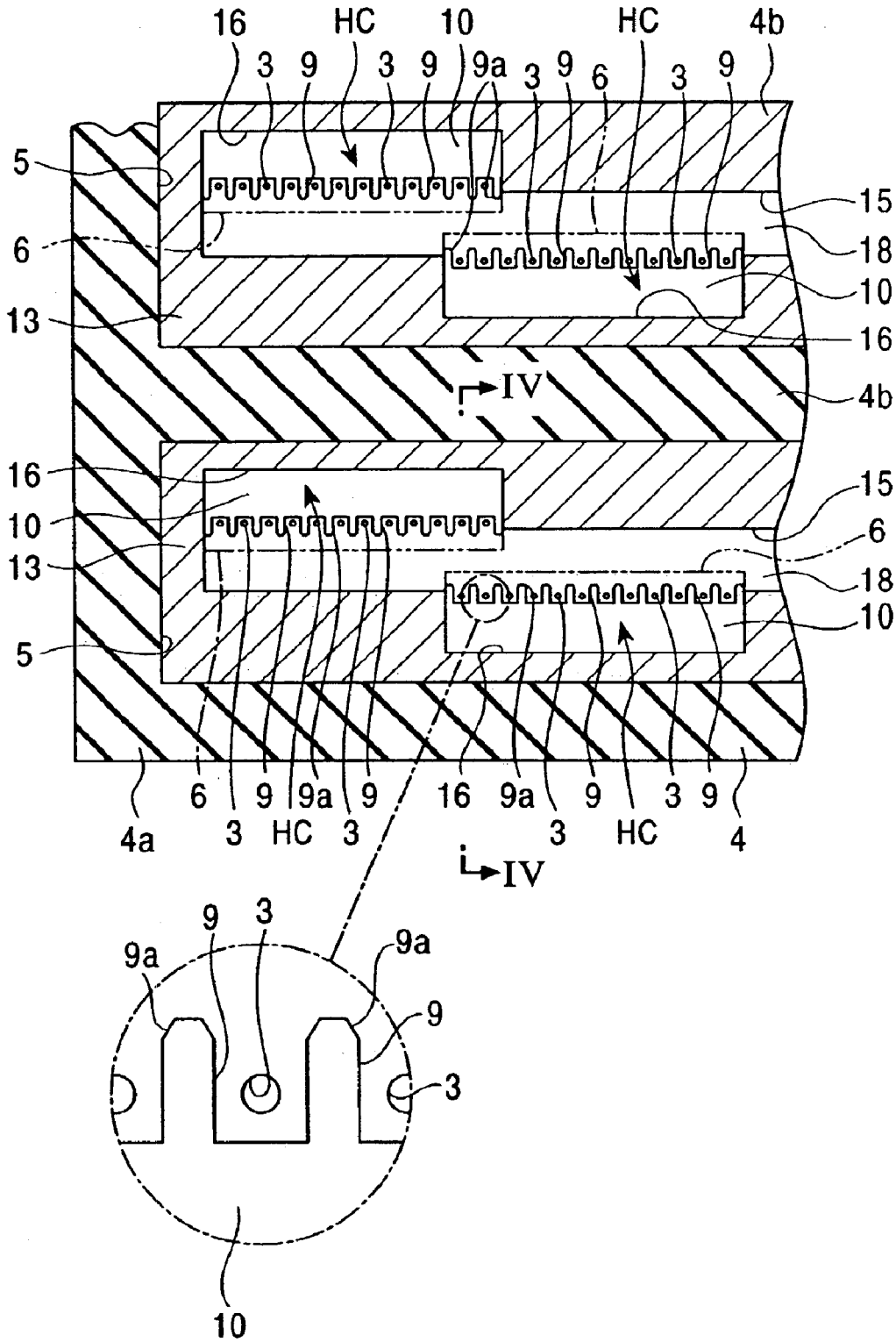
FIG. 3 is a sectional view of an important part of the print head according to the first embodiment.
Figure 4:
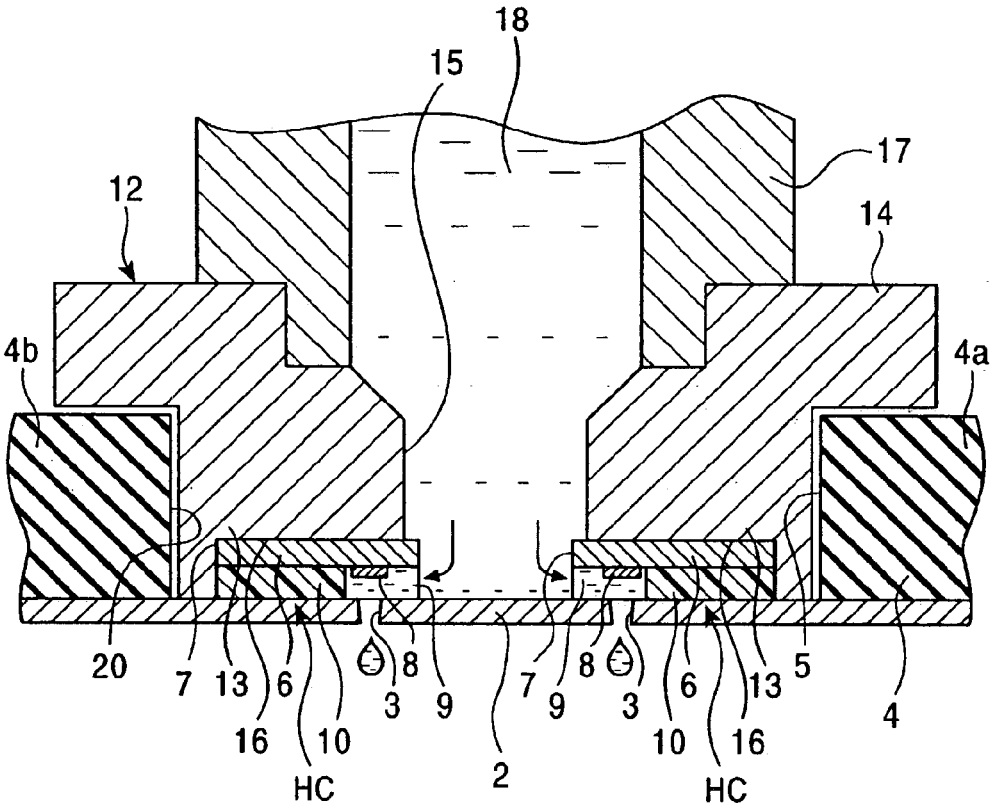
FIG. 4 is a sectional view of FIG. 3 cut along line IV—IV.

Each of the substrate members 6 is constructed by forming heating elements 8 on a surface of a semiconductor substrate 7 formed of silicon, etc., and laminating a barrier layer 10 on the semiconductor substrate 7 at the same side as the side at which the heating elements 8 are formed (see FIGS. 3 and 4). The barrier layer 10 defines side surfaces of ink-pressurizing cells 9; in other words, it serves as the side walls of the ink-pressurizing cells 9. The barrier layer 10 is formed of, for example, a dry film which is curable by light exposure, and is constructed by laminating the dry film over the entire surface of the semiconductor substrate 7, on which the heating elements 8 are formed, and removing unnecessary parts by a photolithography process. Accordingly, the substrate member 6 is completed.

In the substrate members 6, the thickness of the barrier layer 10 is approximately 12 μm, and the heating elements 8 have a square shape of which the length of each side is approximately 18 μm. In addition, the width of the ink-pressurizing cells 9 is approximately 25 μm.

As an example, a case is considered in which the print head 1 is applied to a line printer which prints on 'A4' sized paper in a portrait orientation. In such a case, for a single opening 5 formed in the head frame 4, approximately five thousand ink-ejection nozzles 3 are formed in the nozzle-formed member 2 and sixteen substrate members 6 are laminated thereon. Thus, approximately three hundred and ten ink-ejection nozzles 3 are formed in a single substrate member 6. Accordingly, it is impossible to show the accurate numbers of elements with accurate dimensions in the drawings which are limited in size. Therefore, in order to facilitate understanding, the drawings are partly exaggerated and elements are sometimes omitted.

The substrate members 6 are laminated on the nozzle-formed member 2 by heat-curing the barrier layer 10 at approximately 105° C. Accordingly, the laminating temperature is mainly determined in accordance with the characteristics of the barrier layer 10. Although the laminating temperature of the nozzle-formed member 2 and the substrate members 6 is not limited to 105° C., it is necessary that the laminating temperature of the nozzle-formed member 2 and the head frame 4 be higher than the laminating temperature of the nozzle-formed member 2 and the substrate members 6. This will be explained with reference to a graph shown in FIG. 10.

Figure 10:
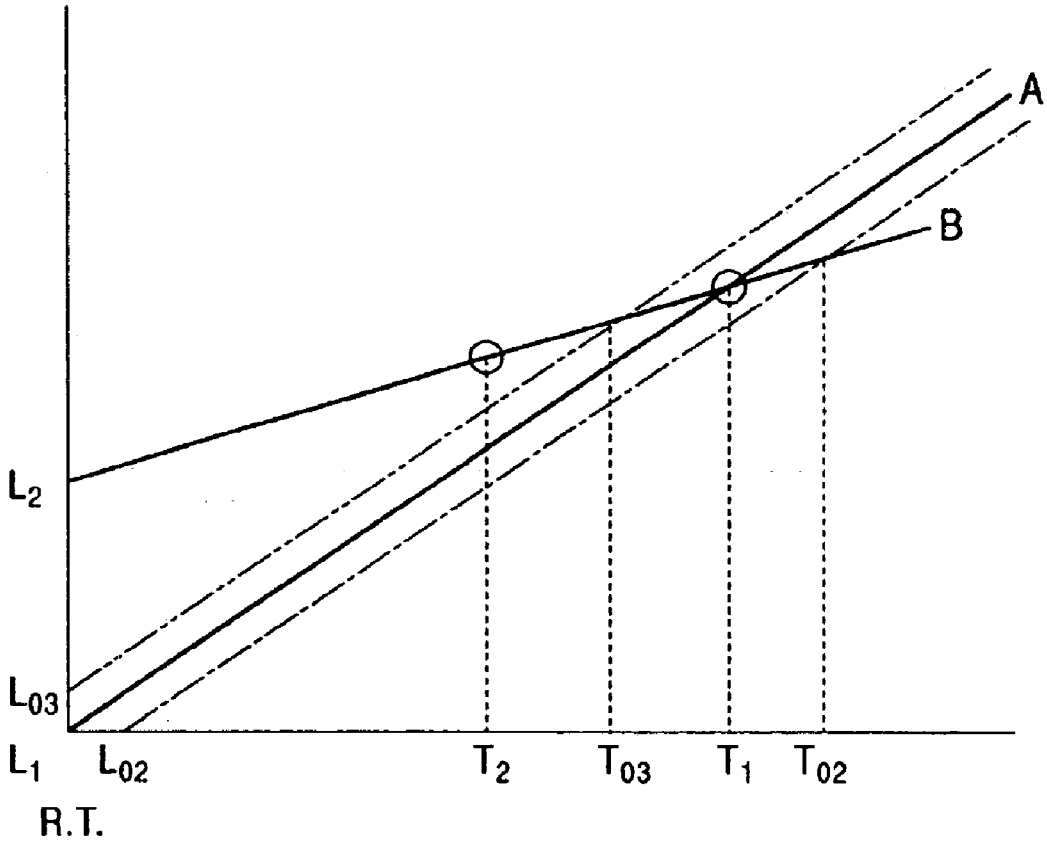
FIG. 10 is a graph showing a laminating temperature of the head frame and the nozzle-formed member and a laminating temperature of the substrate members and the nozzle-formed member along with an extension curve of the interval between ink-ejection nozzles formed in the nozzle-formed member and an extension curve of the interval between heating elements formed in the substrate member.
Figure 11:
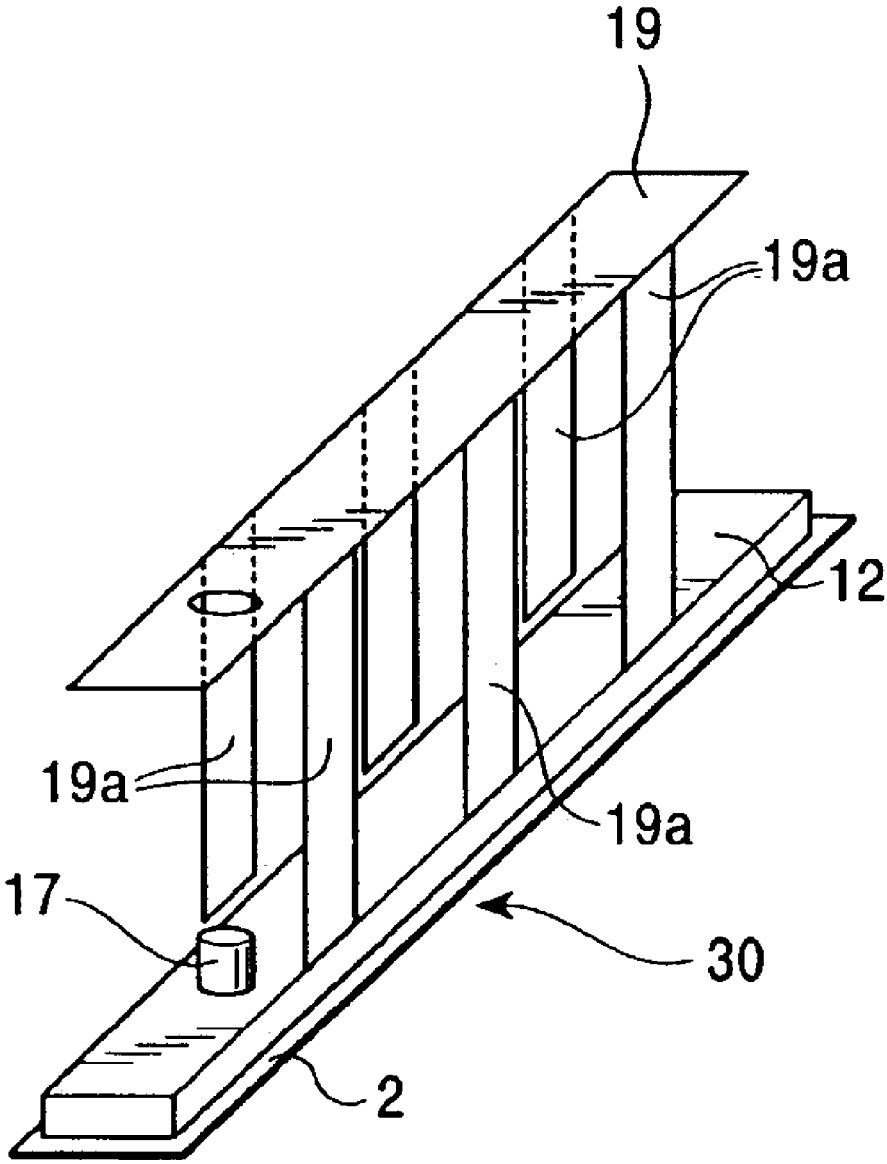
FIG. 11 is a perspective view of a combined body of a print head according to a second embodiment of the present invention and an ink passage plate.
Figure 12:
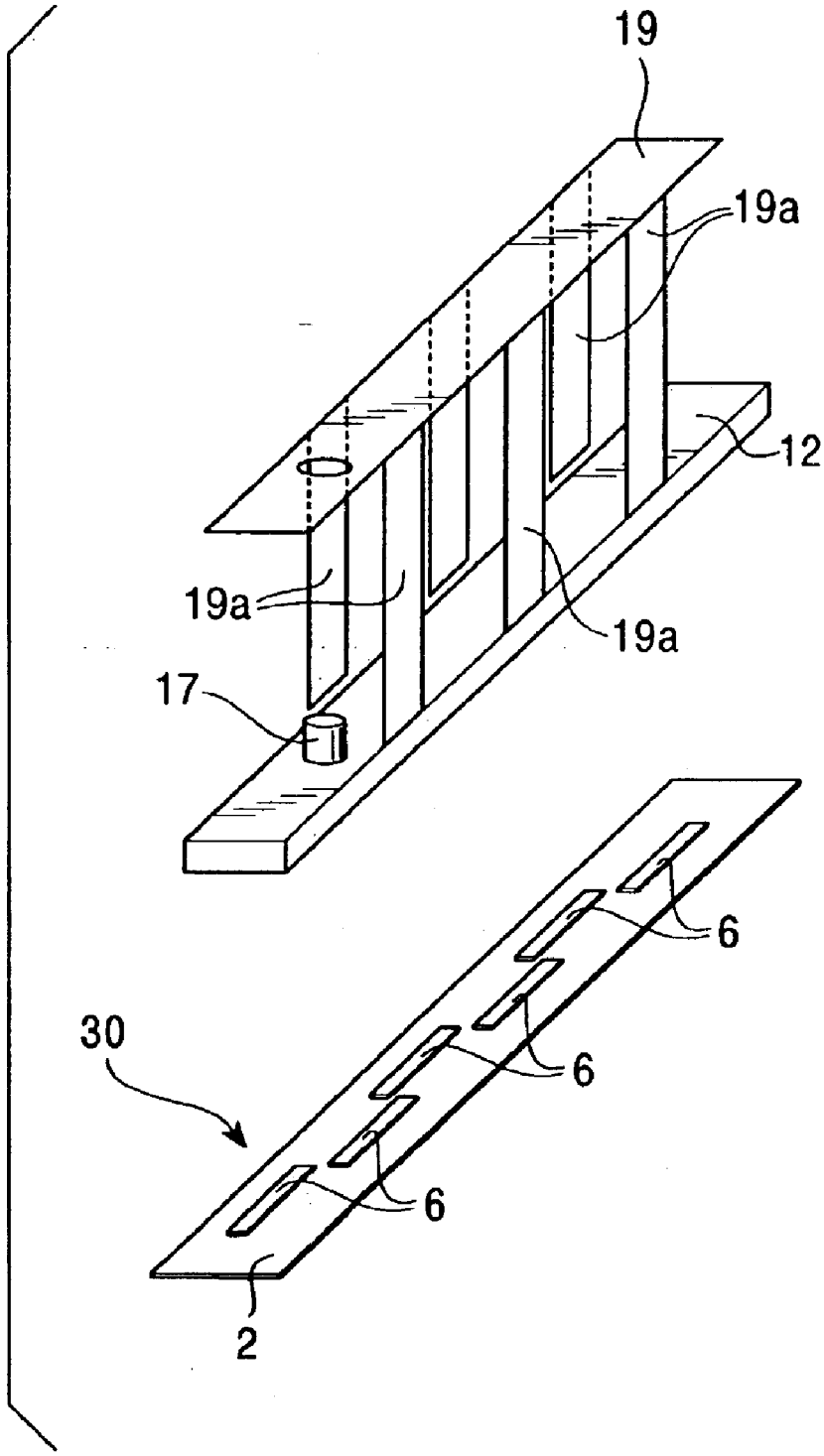
FIG. 12 is an exploded perspective view of the combined body of a print head according to the second embodiment and the ink passage plate.

FIG. 10 is a graph showing the relationship between the temperature and the interval between the ink-ejection nozzles 3 formed in the nozzle-formed member 2 (nozzle interval) and the relationship between the temperature and the interval between the heating elements 8 formed in the substrate members 6 (heater interval). In the graph, curve A shows the relationship between the temperature and the nozzle interval, wherein the nozzle interval at room temperature (R.T.) is $L_1$. In addition, curve B shows the relationship between the temperature and the heater interval, wherein the heater interval at room temperature (R.T.) is $L_2$.

When the coefficient of linear expansion of the nozzle-formed member 2 is $\alpha_1$, the coefficient of linear expansion of the semiconductor substrate 7 is $\alpha_2$, and the temperature is T, the above-described curves A and B can be expressed as follows:

$$L=L_1+L_1\alpha_1 T \qquad A:$$

$$L=L_2+L_2\alpha_2 T \qquad B:$$

wherein, $L_2>L_1$ and $\alpha_1>\alpha_2$.

Therefore, the head frame 4 is laminated on the nozzle-formed member 2 at a temperature $T_1$, at which curve A and curve B cross each other.

Then, the substrate members 6 are laminated on the nozzle-formed member 2 at a temperature $T_2$, which is lower than $T_1$.

When the head frame 4 is laminated on the nozzle-formed member 2 at the temperature $T_1$, the nozzle-formed member 2 tries to shrink by a larger amount than the head frame 4 at a temperature lower than the laminating temperature ($T_1$), and thus becomes tense. The interval between the ink-ejection nozzles 3, that is, the nozzle interval, varies in accordance with the coefficient of linear expansion of the head frame 4. Since the coefficient of linear expansion of the head frame 4 is approximately the same as that of the substrate members 6, the nozzle interval and the heater interval become approximately the same at the same temperature. Accordingly, the displacements between the heating elements 8 and the ink-ejection nozzles 3 do not easily occur.

The nozzle interval of a completed print head 7 is determined by a required precision of a printer in which the print head 7 is to be installed. Accordingly, L2 is determined in a design phase. In such a case, the required L1 can be inversely calculated based on the graph shown in FIG. 10 from the coefficient of linear expansion (1 of the nozzle-formed member 2, the coefficient of linear expansion (2 of the semiconductor substrate 7 (which is also the coefficient of linear expansion of the head frame 4), the laminating temperature T1 of the nozzle-formed member 2 and the head frame 4, and the temperature difference (T between the laminating temperature T1 and room temperature (R.T.). Alternatively, L2 may also be calculated from the following equation.

$$L_1=L_2\ (\alpha_2\Delta T-1)/(\alpha_1\Delta T-1)$$

Due to the differences caused in the manufacturing process, the nozzle interval at room temperature (R.T.) may be too small or large relative to the $L_1$. In such a case, an adjustment can be made by changing the laminating temperature of the head frame 4 and the nozzle-formed member 2.

For example, when the nozzle interval at room temperature (R.T.) is $L_{02}$, which is smaller than $L_1$, the head frame 4 may be laminated on the nozzle-formed member 2 at a temperature $T_{02}$, which is higher than the laminating temperature $T_1$ determined at the design phase. In addition, when the nozzle interval at room temperature (R.T.) is $L_{03}$, which is larger than $L_1$, the head frame 4 may be laminated on the nozzle-formed member 2 at a temperature $T_{03}$, which is lower than the laminating temperature $T_1$ determined at the design phase.

The coefficient of linear expansion of the head frame 4 is preferably lower than that of the nozzle-formed member 2. When the head frame 4 is laminated on the nozzle-formed member 2 and the temperature is reduced to room temperature (R.T.), the nozzle-formed member 2 receives a force from the head frame 4 in either (1) an expanding direction or (2) a shrinking direction. The direction of the applied force is determined by the relationship between their coefficients of linear expansion. When the nozzle-formed member 2 receives the force in the direction (2), there is a risk that concavities and convexities (wrinkles) will be formed in the nozzle-formed member 2. Accordingly, the nozzle-formed member 2 preferably receives the force in the direction (1), the expanding direction, rather than in the direction (2). Thus, preferably, the coefficient of linear expansion of the head frame 4 is lower than that of the nozzle-formed member 2 and approximately the same as that of the substrate members 6.

In addition, the laminating temperature $T_1$ of the head frame 4 and the nozzle-formed member 2 is preferably higher than any temperatures at which following processes are performed. Accordingly, the nozzle-formed member 2 constantly receives a tension during the processes performed after the lamination of the head frame 4 and the nozzle-formed member 2, so that no wrinkles are formed. In the above-described example, the head frame 4 is laminated on the nozzle-formed member 2 at 150° C., and then the substrate members 6 are laminated on the nozzle-formed member 2 at 105° C.

Accordingly, a head unit 11 is formed by combining the head frame 4, the nozzle-formed member 2, and the substrate members 6, and ink-passage plates 12 are then attached to the head unit 11 (see FIG. 1).

Figure 2:
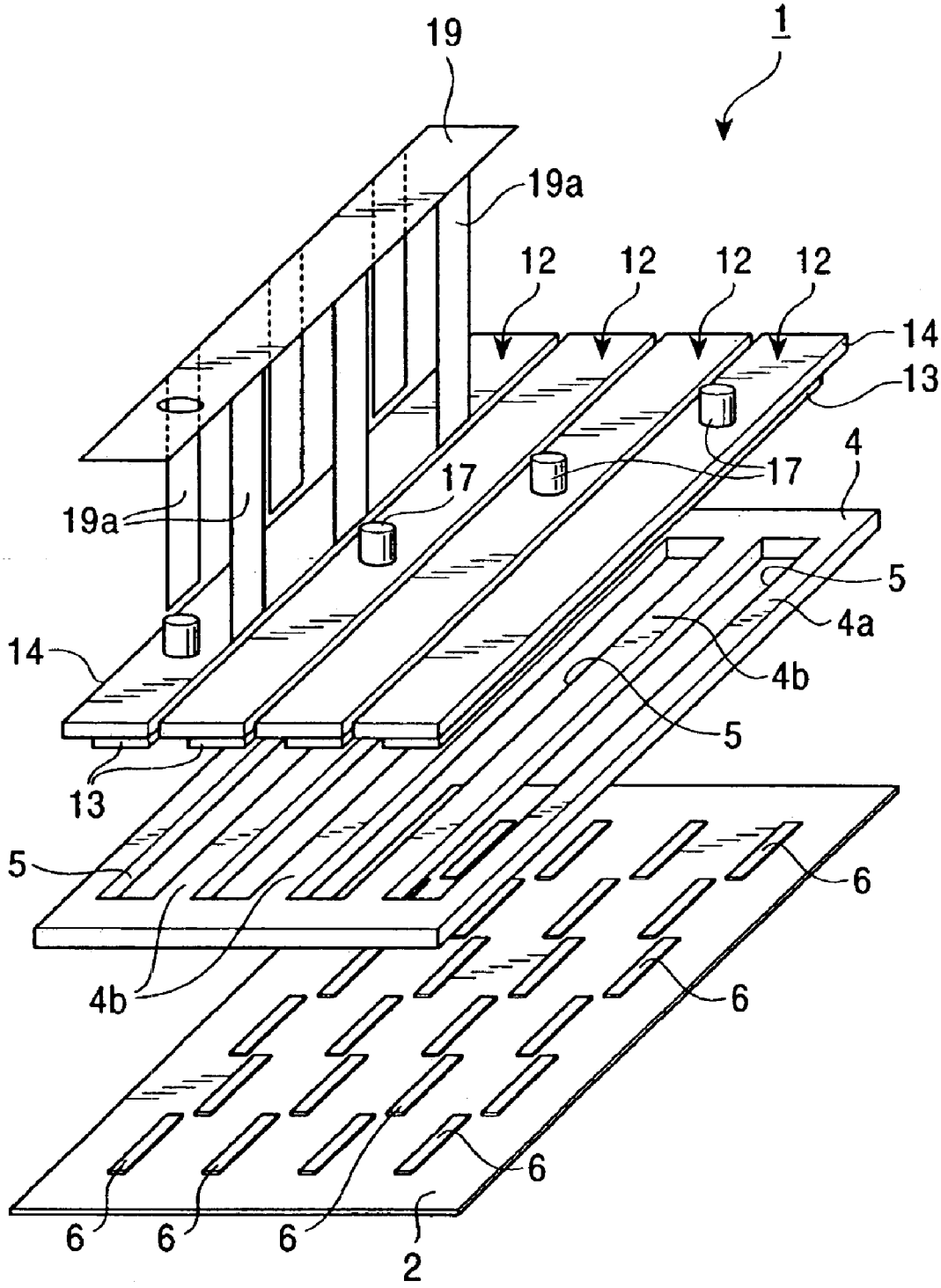
FIG. 2 is an exploded perspective view of the print head according to the first embodiment.

One ink-passage plate 12 is provided for one color, and four ink-passage plates 12 individually corresponding to four colors are provided in total (see FIGS. 1 and 2). The ink-passage plates 12 are formed of a material which does not easily deform and which has ink resistance. Each of the ink-passage plates 12 includes a chamber portion 13 which fits into one of the openings 5 formed in the head frame 4, and a flange portion 14 which is integrally formed with the chamber portion 13 at one side thereof. The flange portion 14 is formed so as to have a size larger than the planer shape of the openings 5. The chamber portion 13 is provided with an opening 15 at the side opposite to the side at which the flange portion 14 is formed, and notches 16 for positioning the substrate members 6 are formed in the side walls of the opening 15 (see FIGS. 3 and 4). In addition, the flange portion 14 is provided with an ink-supply tube 17, which projects from the side opposite to the side at which the chamber portion 13 is formed, and which is connected to the above-described opening 15 (see FIGS. 1, 2, and 4).

The notches 16 are arranged in two lines across the Opening 15 in such a manner that end portions of the opposing notches 16 overlap each other in the direction in which they are arranged. The size of the notches 16 is determined such that the substrate members 6 can fit therein.

Each of the ink-passage plates 12 is adhered to the head frame 4 in such a manner that the chamber portion 13 fits into the opening 5 and the flange portion 14 contacts the outside frame portion 4*a* and the bridge portions 4*b* of the head frame 4. In addition, the substrate members 6 laminated on the nozzle-formed member 2 are positioned inside the notches 16 formed in the chamber portion 13 and are adhered to the chamber portion 13 (see FIGS. 3 and 4).

By combining the ink-passage plates 12 with the head unit 11 as described above, closed spaces surrounded by the chamber portions 13 of the ink-passage plates 12 and the nozzle-formed member 2 are formed. These closed spaces are connected to the exterior environment only through the ink-supply tubes 17, and serve as ink passages 18 for transferring ink which is supplied through the ink-supply tubes to each of the ink-pressurizing cells 9. Accordingly, a single ink passage 18 is connected to a plurality of head chips HC, and the structure for supplying ink is made simpler than a print head in which the head chips are individually provided with ink passages.

In a single closed space, the substrate members 6 are individually fitted inside the notches 16, and are arranged in two rows in a zigzag manner so that end portions of the substrate members 6 overlap one another, and in such a manner that ink inlets 9*a* of the ink-pressurizing cells 9 oppose one another. Thus, the ink passage 18 is formed between the two rows of the substrate members 6, and the ink-pressurizing cells 9 are connected to the ink passage 18 via the ink inlets 9*a* (see FIG. 3).

Four flexible substrates 19, which electrically connect the heating elements 8 formed in the substrate members 6 to an exterior control unit, are individually provided for four colors (only one of them is shown in FIG. 2). Each of the flexible substrates 19 is provided with connecting tabs 19*a*, which are inserted through openings 20 formed between the head frame 4 and the ink-passage plates 12 (see FIG. 4), and extend to the substrate members 6. The connecting tabs 19*a* are electrically connected to contact points (not shown), which are individually connected to the heating elements 8 formed in the substrate members 6.

The ink-supply tubes 17 provided on the ink-passage plates 12 are individually connected to ink tanks (not shown), which individually contain inks of different colors, and the ink passages 18 and the ink-pressurizing cells 9 are filled with ink supplied from the ink tanks.

When a current pulse is applied for a short time such as 1 to 3 $\mu$s to some of the heating elements 8 selected in accordance with a command issued by the control unit of the printer, the corresponding heating elements 8 are rapidly heated. Accordingly, at each of the corresponding heating elements 8, a bubble of ink vapor (ink bubble) is generated at the surface thereof. Then, as the ink bubble expands, a certain volume of ink is pushed ahead, and the same volume of ink is ejected out from the corresponding ink-ejection nozzle 3 as-an ink drop. The ink drop, which is ejected from the ink-ejection nozzle h, adheres (lands on) to a print medium such as a piece of paper, etc. Then, the ink-pressurizing cells 9 from which the ink drops are ejected are immediately refilled with ink through the ink passages 18 by the same amount as the ejected ink drops.

The manufacturing process of the above-described print head 1 will be briefly explained below with reference to FIGS. 5 to 9.

Figure 5:
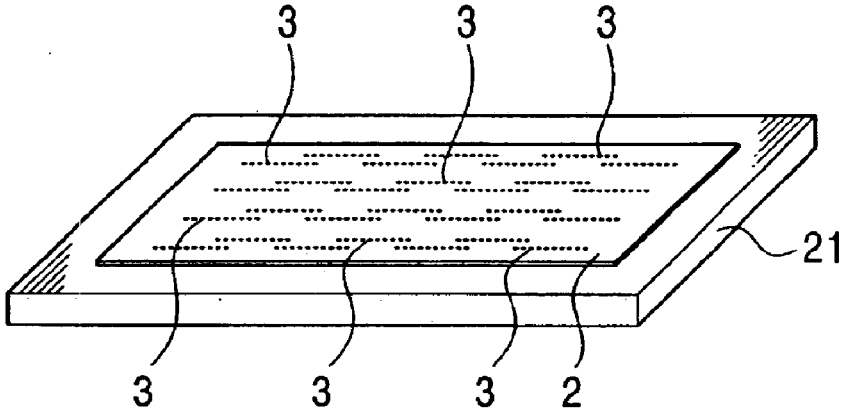
FIG. 5 is a perspective view showing a state in which a nozzle-formed member is disposed on a supporting jig in a manufacturing process of the print head according to the first embodiment.

First, the nozzle-formed member 2 is formed by an electroforming technique, and is disposed on a supporting jig 21 having a flat surface (see FIG. 5). The reason why the nozzle-formed member 2 is disposed on the supporting jig 21 is because the nozzle-formed member 2 is extremely thin and it cannot maintain its shape by itself.

Figure 6:
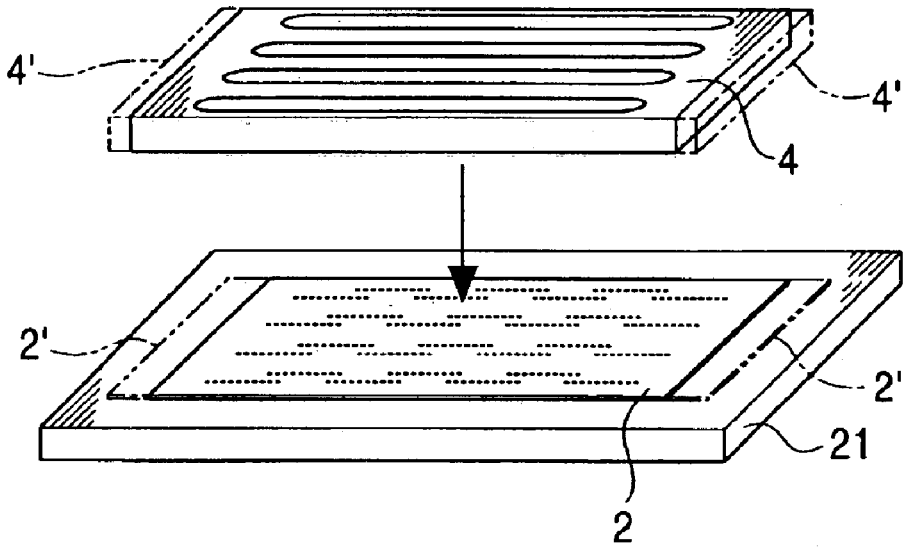
FIG. 6 is a schematic representation showing a step of combining a head frame and the nozzle-formed member in the manufacturing process of the print head according to the first embodiment.

Next, the head frame 4 is laminated on the nozzle-formed member 2 disposed on the supporting jig 21 by heating a heat-setting adhesive sheet, for example, an epoxy adhesive sheet, at 150° C. (see FIG. 6). In FIG. 6, reference numerals 2' and 4' schematically show the shapes of the nozzle-formed member 2 and the head frame 4 which extend by being heated to 150° C.

Figure 7:
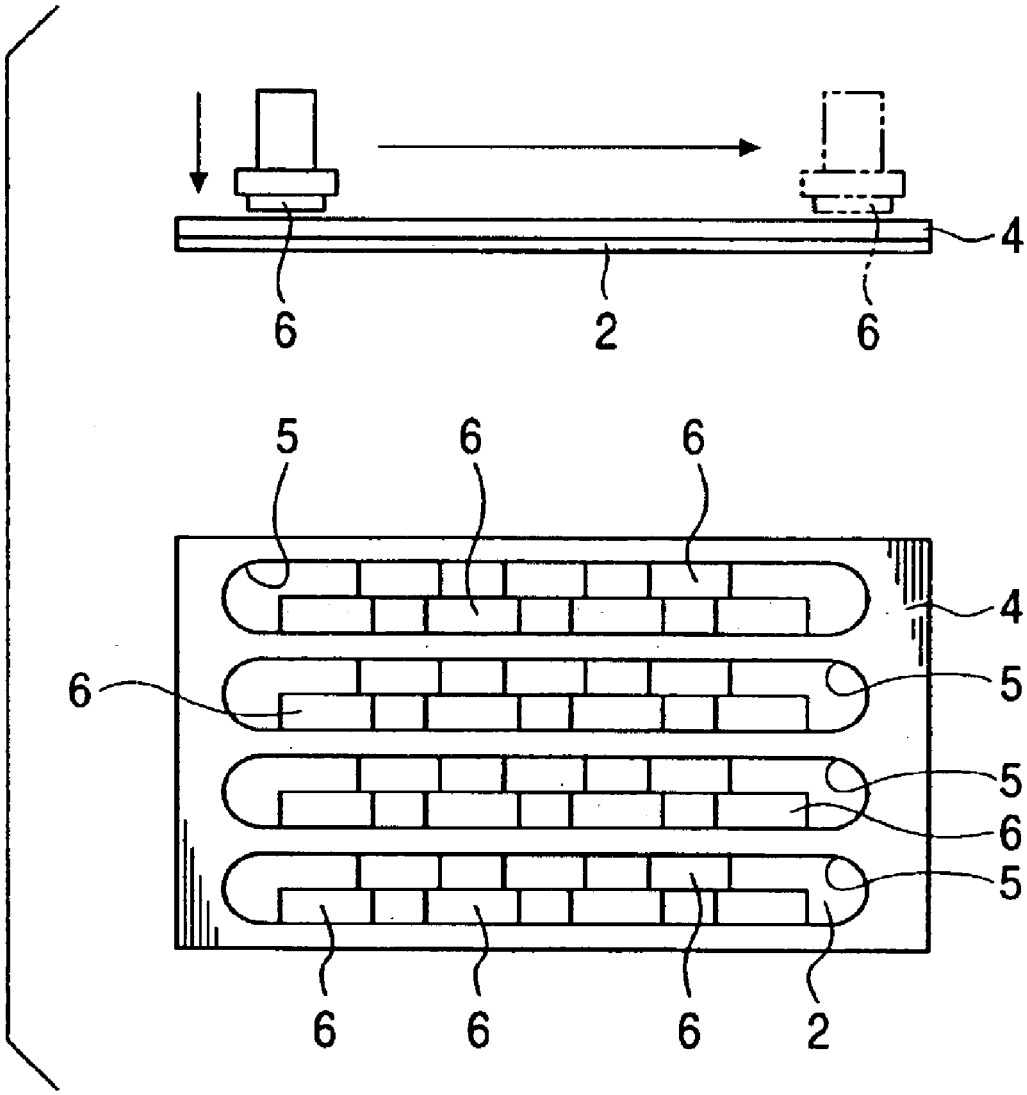
FIG. 7 is a schematic representation showing a step of combining substrate members and the nozzle-formed member in the manufacturing process of the print head according to the first embodiment.
Figure 8:
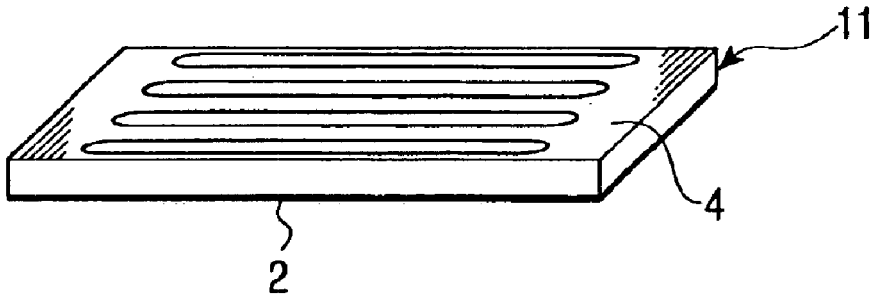
FIG. 8 is a schematic representation showing a head unit which is constructed by combining the head frame, the nozzle-formed member, and the substrate members in the manufacturing process of the print head according to the first embodiment.

Next, the supporting jig 21 is removed, and the substrate members 6 are laminated on the nozzle-formed member 2 at 105° C., so that the head chips HC are formed (see FIG. 7). FIG. 7 only schematically shows the laminating step, and only seven substrate members 6 are shown for each color.

Figure 9:
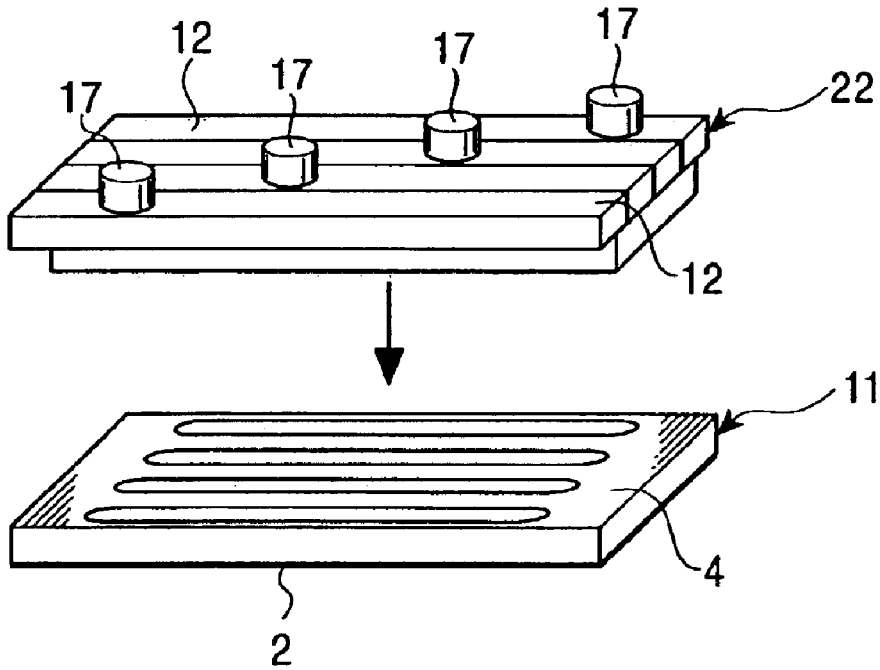
FIG. 9 is a schematic representation showing a step of combining the head unit and an ink-passage unit in the manufacturing process of the print head according to the first embodiment.

Accordingly, the head unit 11 is completed (see FIG. 8), and an ink-passage unit 22, which is constructed by another process, is attached to the head unit 11 (see FIG. 9). The ink-passage unit 22 is constructed by combining the above-described four ink-passage plates 12 using a connecting member (not shown).

In the print head 1, the head frame 4, which has approximately the same coefficient of linear expansion as that of the semiconductor substrates 7 (for example, silicon substrates) which are the base substrates of the substrate members 6, is first laminated on the nozzle-formed member 2. Then, the substrate members 6 are laminated on the nozzle-formed member 2 at a temperature lower than the laminating temperature of the head frame 4 and the nozzle-formed member 2. Accordingly, the interval between the ink-ejection nozzles 3 formed in the nozzle-formed member 2 and the interval between the heating elements 8 formed in the substrate members 6 are always the same at temperatures lower than the laminating temperature of the nozzle-formed member 2 and the head frame 4. Thus, a print head having improved characteristics of ink drop ejection can be obtained. Even when the size of the substrate members 6 and the numbers of heating elements 8 and the ink-ejection nozzles 3 provided for a single substrate member 6 are increased, displacements between the exothermic elements 8 and the ink-discharge nozzles 3 do not easily occur. Accordingly, the size of the print head 1 can be easily increased, and thus the print head 1 is especially suitable for long print heads such as print heads for line printers, etc.

In addition, by laminating the head frame 4 on the nozzle-formed member 2, the nozzle-formed member 2 obtains high rigidity. Thus, as described above, it is possible to form a print head for a line printer in which four print heads for four colors are combined.

Furthermore, since the head chips HC are disposed in a zigzag manner in the above-described print head, even when head chips HC having different printing characteristics are arranged, print mottling can be made less conspicuous. In addition, since a plurality of head chips HC are formed on a single nozzle-formed member, positional accuracy of the ink-ejection nozzles can be increased and the printing characteristics can be improved. In addition, since a single ink passage is connected to a plurality of head chips HC, the structure for supplying ink to each of the head chips HC can be made simpler.

The above-described print head 1 is suitable as a print head that is long in a direction perpendicular to the feed direction of a print medium, and is especially suitable as a line head. Accordingly, print speed can be increased.

Although the present invention was applied to a print head for a full-color, bubble ink jet printer in the above-described embodiment, the present invention may also be applied to print heads for monocolor printers. In addition, even in the case in which the present invention is applied to a print head for a full-color printer, the present invention is not limited to the above-described structure in which the four print heads for four colors are combined, and an individual print head may be prepared for each color.

The shapes and structures of the members of the first embodiment are described merely for illustrating an example of a print head to which the present invention is applied, and are not intended to limit the scope of the present invention.

Next, a print head according to a second embodiment of the present invention will be described below.

In the following descriptions of the second embodiment, explanations regarding the parts having the same construction as in the first embodiment are omitted, and components similar to those in the first embodiment are denoted by the same reference numerals.

In order to attain the object of the present invention, a print head 30 of according to the second embodiment includes the substrate members 6 and the nozzle-formed members 2 which have approximately the same coefficient of linear expansion. Thus, even when heat is applied in the fabrication process, displacements between the heating elements 8 and the ink-ejection nozzles 3, and between the ink-pressurizing cells 9 and the ink-ejection nozzles 3, which occur due to the difference in shrinkage rates between the substrate members 6 and the nozzle-formed member 2, can be reduced. Accordingly, variations of the ejecting direction and ejection speed, which occur due to the displacements between the heating elements 8 and the ink-ejection nozzles 3, and between the ink-pressurizing cells 9 and the ink-ejection nozzles 3, can be reduced, and degradation of the printing quality can be prevented.

Accordingly, various adhesives including heat-setting adhesives can be used in the fabrication process.

When a print head is driven (when the ink is ejected), the temperature of the ink is increased for an instant, so that the temperatures of the substrate members and of the nozzle-formed member are also increased. Thus, when the coefficients of linear expansion of the substrate members and of the nozzle-formed member are different, a force to separate the substrate members and the nozzle-formed member is generated, and durability of the print head is degraded. In contrast, according to the above-described print head 30, the difference in the coefficients of linear expansion between the substrate members 6 and the nozzle-formed member 2 is extremely small, so that high durability can be obtained.

Although the present invention was applied to a line head which prints on 'A4' sized paper in a portrait orientation in the second direction, the present invention may also be applied to other print heads such as serial heads, etc.

In addition, although the print head 30 was constructed of a plurality of substrate members 6 in the second embodiment, the present invention is not limited to this, and a line of 21 cm can also be covered by a single substrate member 6. When the length of the substrate member 6 is increased as described above, the influence of the difference in the coefficients of linear expansion between the substrate members 6 and the nozzle-formed member 2 is increased. Accordingly, in such a case, the use of the print head according to the present invention becomes more advantageous.

The print head 30 according to the second embodiment will be further illustrated below.

For example, the print head 30 may be manufactured by a following process using a silicon wafer (single-crystal silicon) as a material of the semiconductor substrates 7, which are the base members of the substrate members 6, a dry film resist as a material of the barrier layer 10, and INVAR alloy as a material of the nozzle-formed member 2.

The ink-ejection nozzles 3 are formed in the nozzle-formed member 2 by a spray etching process using a ferric chloride solution.

The heating elements (heaters) 8 are formed by laminating a thin film layer on the semiconductor substrate 7 formed of the silicon wafer, and then the dry film resist is laminated on the semiconductor substrate 7. Then, the side walls of the ink-pressurizing cells 9 are formed by removing unnecessary parts of the dry film resist by a photolithography process. Accordingly, the substrate member 6 is formed.

The substrate members 6 and the nozzle-formed member 2 are positioned relative to each other, and are laminated by heating them at 150° C. for 15 minutes.

Figure 13:
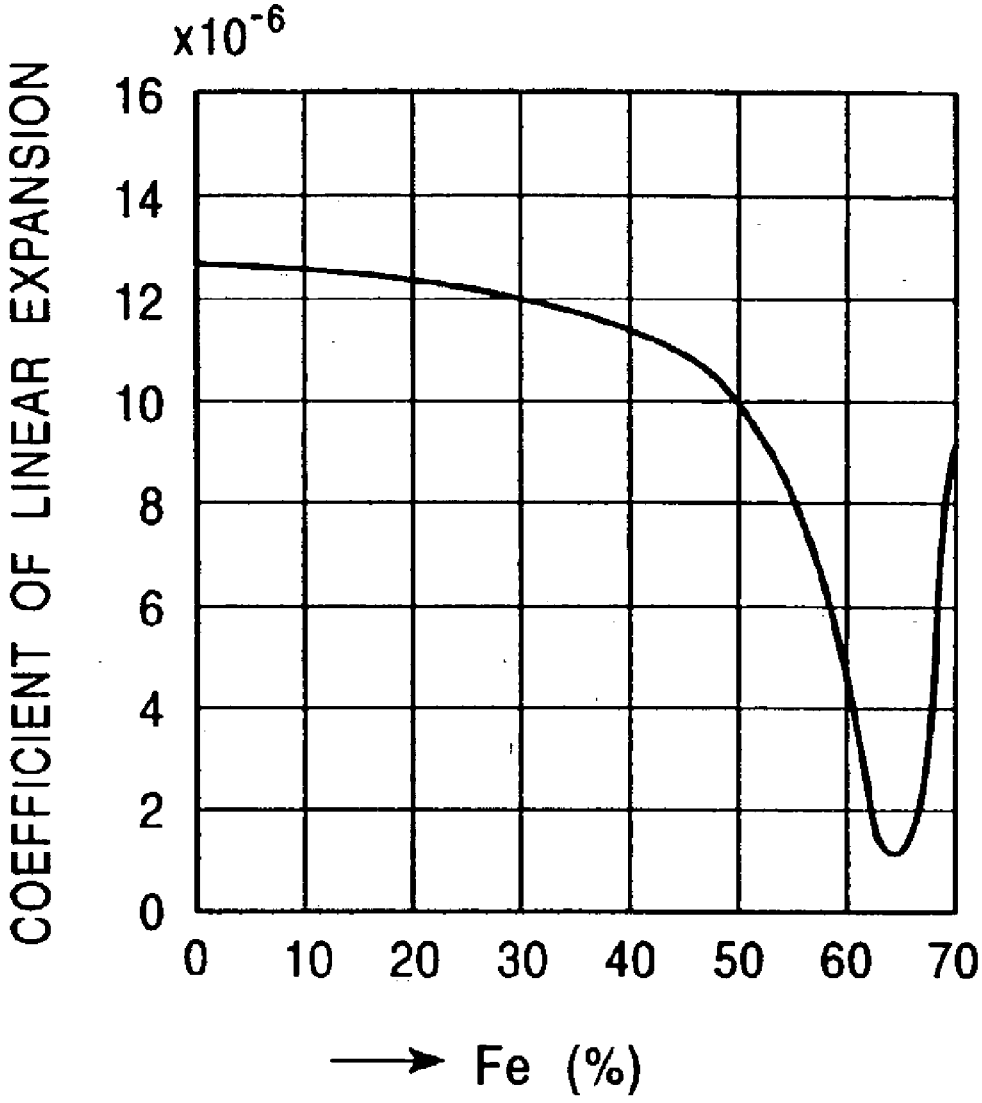
FIG. 13 is a graph showing the relationship between the content of ferrum (Fe) in an ferrum-nickel (Fe—Ni) alloy and the coefficient of linear expansion of the alloy.

INVAR alloy, of which the nozzle-formed member 2 is formed, consists of 64% ferrum (Fe) and 36% nickel (Ni), and, as can be seen from a graph shown in FIG. 13, has a coefficient of linear expansion of 1.2 (10–6. Thus, the coefficient of linear expansion of IN VAR alloy is almost the same as that of silicon (2.6 (10–6), which is the base material of the substrate member 6. When the print head 30 is constructed as described above, the displacements between the heating elements 8 and ink-ejection nozzles 3, and between the ink-pressurizing cells 9 and the ink-ejection nozzles 3, are of only an extremely small amount, and degradation of the printing quality can be prevented.

As described above, INVAR alloy consists of 64% ferrum (Fe) and 36% nickel (Ni), and has the coefficient of linear expansion of 1.2 (10–6, which is the minimum value in the graph shown in FIG. 13. When the content of ferrum (Fe) is close to 64%, the coefficient of linear expansion becomes higher than the minimum value (see FIG. 13). Accordingly, an alloy, in which the content of ferrum (Fe) is adjusted around 64% so that the difference in coefficients of linear expansion between the silicon and the alloy is reduced, may also be used.

According to the second embodiment, the print head 30 may also have the following construction.

The base material of the substrate members 6 and the material of the barrier layer 10 are the same as described above, and Pyrex glass (which is a trademark of Corning Inc. for a hard glass, No. 7740), is used as the material for the nozzle-formed member 2. The coefficient of linear expansion of Pyrex glass is $3.3\times10^{-6}$. The ink-ejection nozzles 3 are formed in the nozzle-formed member 2 by a reactive ion etching (RIE) process using a chromium layer as a mask.

When the print head 30 constructed as described above is used for printing, the displacements hardly occur, and degradation of the printing quality can be prevented.

Furthermore, according to the second embodiment, the print head 30 may also be, for example, a line head (size 'A6') having a length of 105 mm, in which one substrate member 6 is laminated on one nozzle-formed member 2. The base material of the substrate member 6, the material of the barrier layer 10, and the material of the nozzle-formed member 2 may be the same as described above.

Since the difference in coefficients of linear expansion between the substrate member 6 and the nozzle-formed member 2 is extremely small, the displacements between the heating elements 8 and the ink-ejection nozzles 3, and between the ink-pressurizing cells 9 and the ink-ejection nozzles 3, are also extremely small. Even the maximum displacement between the heating elements 8 and the ink-pressurizing cells 9 is only several micrometers. Accordingly, degradation of the printing quality is almost completely prevented.

The shapes and structures of the members of the above-described second embodiment are described merely for illustrating an example of a print head to which the present invention is applied, and are not intended to limit the scope of the present invention.

Next, a print head according to a third embodiment of the present invention will be described below.

In the above-described first embodiment, a construction for reducing the displacements between the heating elements 8 and ink-ejection nozzles 3, and between the ink-pressurizing cells 9 and the ink-ejection nozzles 3 was suggested.

More specifically, according to the first embodiment, the head frame 4 formed of a material having the same coefficient of linear expansion as the semiconductor substrate 7, which is the base substrate of the substrate member 6, is laminated on the nozzle-formed member 2 at a high temperature. Then, the substrate member 6 may be laminated on the nozzle-formed member 2 at a lower temperature than the laminating temperature of the head frame 4 and the nozzle-formed member 2.

Accordingly, after the nozzle-formed member 2 is laminated on the head frame 4, the interval between the ink-ejection nozzles 3 formed in the nozzle-formed member 2 varies in accordance with the coefficient of linear expansion of the head frame 4. Since the coefficient of linear expansion of the head frame 4 is approximately the same as that of the substrate member 6, the intervals between the heating elements 8 and the ink-pressurizing cells 9 formed on the substrate member 6, and the interval between the ink-ejection nozzles 3 formed in the nozzle-formed member 2 vary at the same rate. Accordingly, the problem which occurs due to the displacements between the heating elements c and the ink-ejection nozzles 3, and between the ink-pressurizing cells 9 and the ink-ejection nozzles 3, can be avoided.

In order to obtain the above-described effect, the coefficient of linear expansion of the head frame 4 is preferably lower than that of the nozzle-formed member 2. However, in such a case, there is a risk that the head frame 4 will warp due to the difference in coefficients of linear expansion between the head frame 4 and the nozzle-formed member 2.

More specifically, in the case in which the coefficient of linear expansion of the nozzle-formed member 2 is higher than that of the head frame 4, the nozzle-formed member 2 shrinks at a higher rate compared to the head frame 4 when the environmental temperature is reduced from the laminating temperature. Accordingly, there is a risk that the head frame 4 will warp in such a manner that the side surface on which the nozzle-formed member 2 is laminated becomes concave (see FIG. 14).

Figure 14:
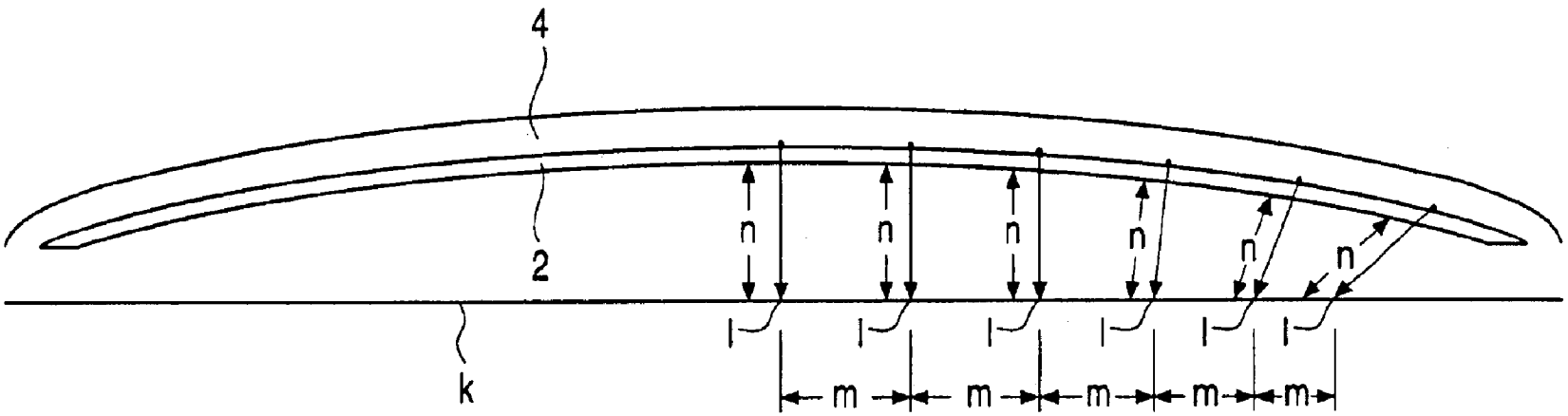
FIG. 14 is a side view showing a condition.

As shown in FIG. 14, when the head frame 4 warps, the ejecting direction of the ink drops toward a print medium k such as a piece of paper, etc., varies, and intervals m between landing points 1 of the ink drops on the print medium k become narrower toward the peripheral portion. Such non-uniformity of the interval m between the landing points 1 causes deformation of a printed image similar to spherical aberration of a lens. Accordingly, the printing quality is degraded.

In addition, when the head frame 4 warps, travel distances n of the ink drops between the ink-ejection nozzles and the print medium k become shorter toward the peripheral portion. When the travel distances n differ as described above, the ink drops ejected at positions closer to the peripheral portion reach the print medium earlier than the ink drops ejected at positions closer to the central portion. Accordingly, when such a print head is used in a line printer, printed lines are deformed in such a manner that central parts are displaced in a direction reverse to the paper feed direction (in a delay direction) relative to the peripheral parts. Accordingly, the printing quality is degraded.

Accordingly, an object of the third embodiment is to prevent warping of a lamination surface of the frame member, that is, a surface on which the nozzle-formed member is laminated, and to avoid the problem which occurs due to the warping of the lamination surface of the frame member.

In the following descriptions of the third embodiment, explanations regarding the parts having the same construction as in the first embodiment are omitted, and components similar to those in the first embodiment are denoted by the same reference numerals.

Figure 15:
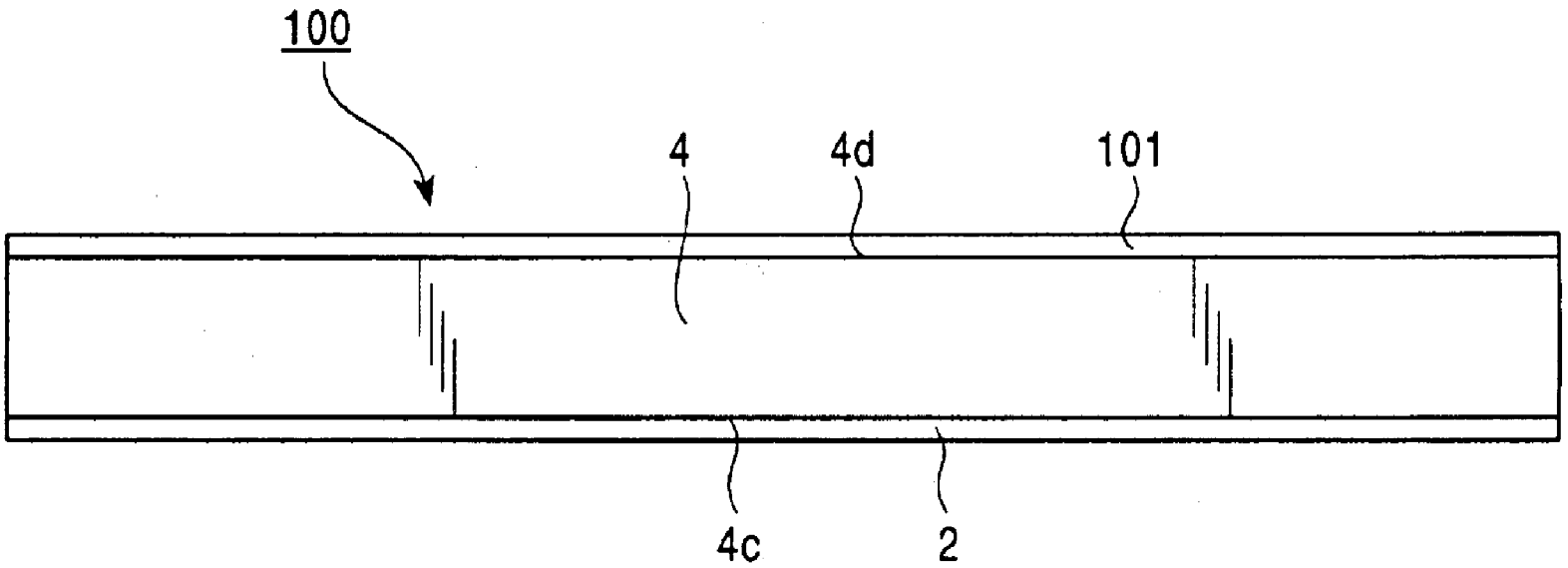
FIG. 15 is a schematic side view of a print head according to a third embodiment of the present invention.

As shown in FIG. 15, in a print head 100 according to the third embodiment, a warp-suppressing member 101 is laminated on a surface 4*d* of the head frame 4 which is at the opposite side of a lamination surface 4*c*, on which the nozzle-formed member 2 is laminated. When the nozzle-formed member 2 is formed of nickel or a material comprising nickel as in the first embodiment, the warp-suppressing member 101 is preferably formed of nickel or a material comprising nickel.

The warp-suppressing member 101 is laminated on the head frame 4 at the same temperature as the laminating temperature of the nozzle-formed member 2 and the head frame 4. In the above-described case, the warp-suppressing member 101 is laminated on the head frame 4 at 150° C.

In the print head 100, the two surfaces 4*c* and 4*d* at the opposite sides of the head frame 4 receive the same tension at the operating temperature. Accordingly, the head frame 4 can be prevented from warping.

Figure 16:
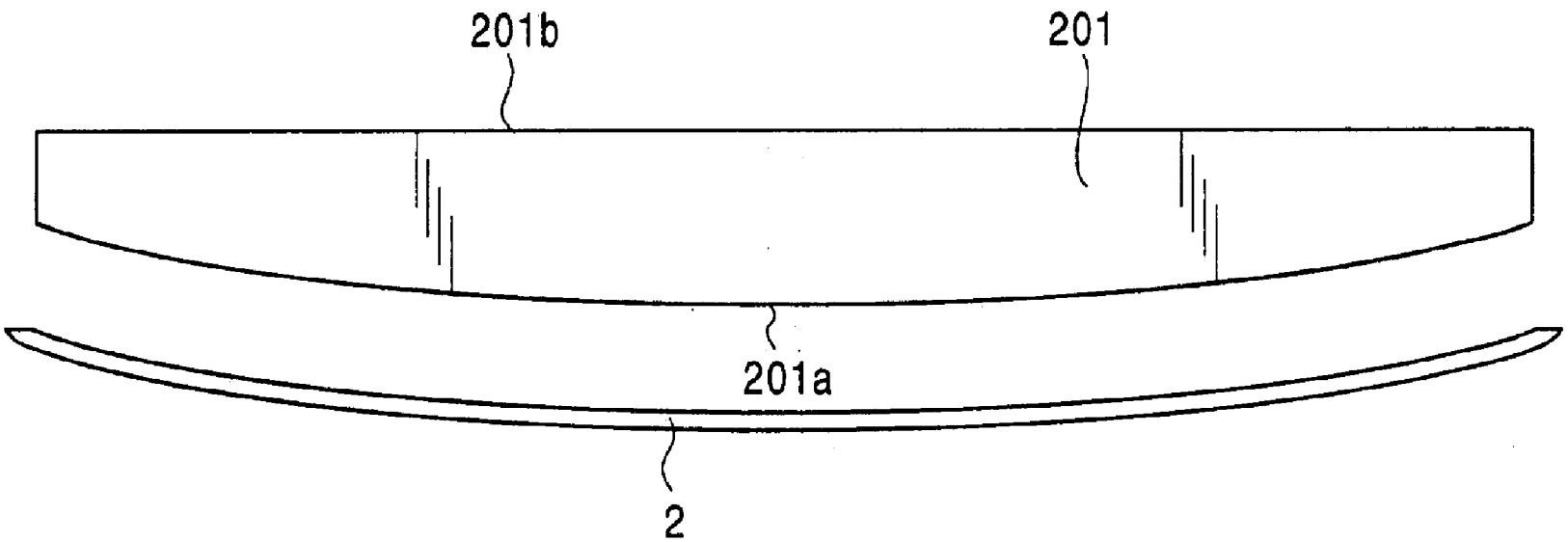
FIG. 16 is a schematic side view showing a state before a nozzle-formed member and a frame member are laminated in accordance with an example of a manufacturing method for a print head of the third embodiment.
Figure 17:
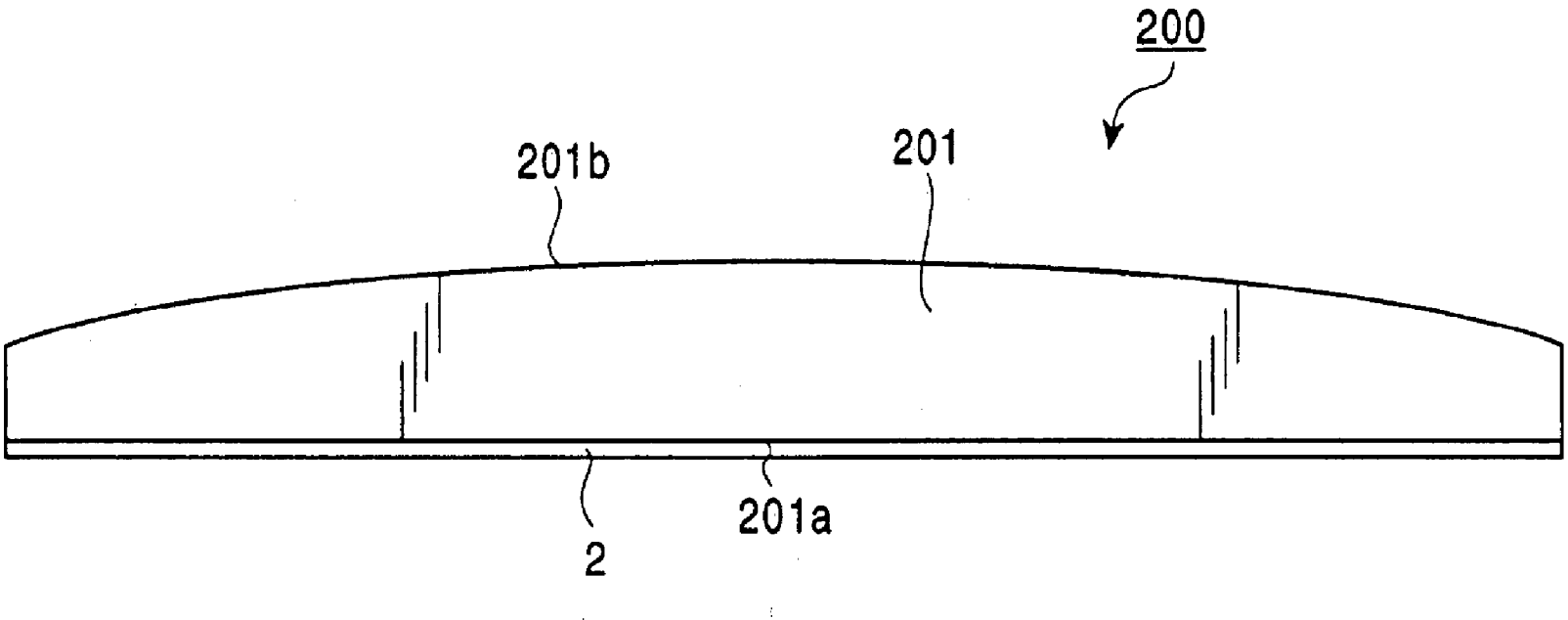
FIG. 17 is a schematic perspective view showing a state in which the temperature is reduced to room temperature after laminating the nozzle-formed member and the frame member.

FIGS. 16 and 17 show an example of a manufacturing method for a print head according to the third embodiment of the present invention.

First, a lamination surface 201*a* of a head frame 201, on which the nozzle-formed member 2 is to be laminated, is formed so as to be convex, and a surface 201*b* at the opposite side of the lamination surface 201*a* is formed so as to be flat. The curvature of the lamination surface 201*a* is determined such that deformation of the head frame 201, which occurs at the operating temperature due to the difference in coefficients of linear expansion between the head frame 201 and the nozzle-formed member 2, can be compensated for.

Then, the nozzle-formed member 2 is laminated on the lamination surface 201*a* of the head frame 201 at a temperature higher than the operating temperature, for example, at 150° C. (see FIG. 16).

In a print head 200 which is constructed as described above, the lamination surface 201*a* of the head frame 201 deforms at the operating temperature due to a shrinking force of the nozzle-formed member 2. However, since the lamination surface 201*a* is formed so as to be convex at first, the lamination surface 201*a* becomes flat by receiving the shrinking force (see FIG. 17).

Figure 18:
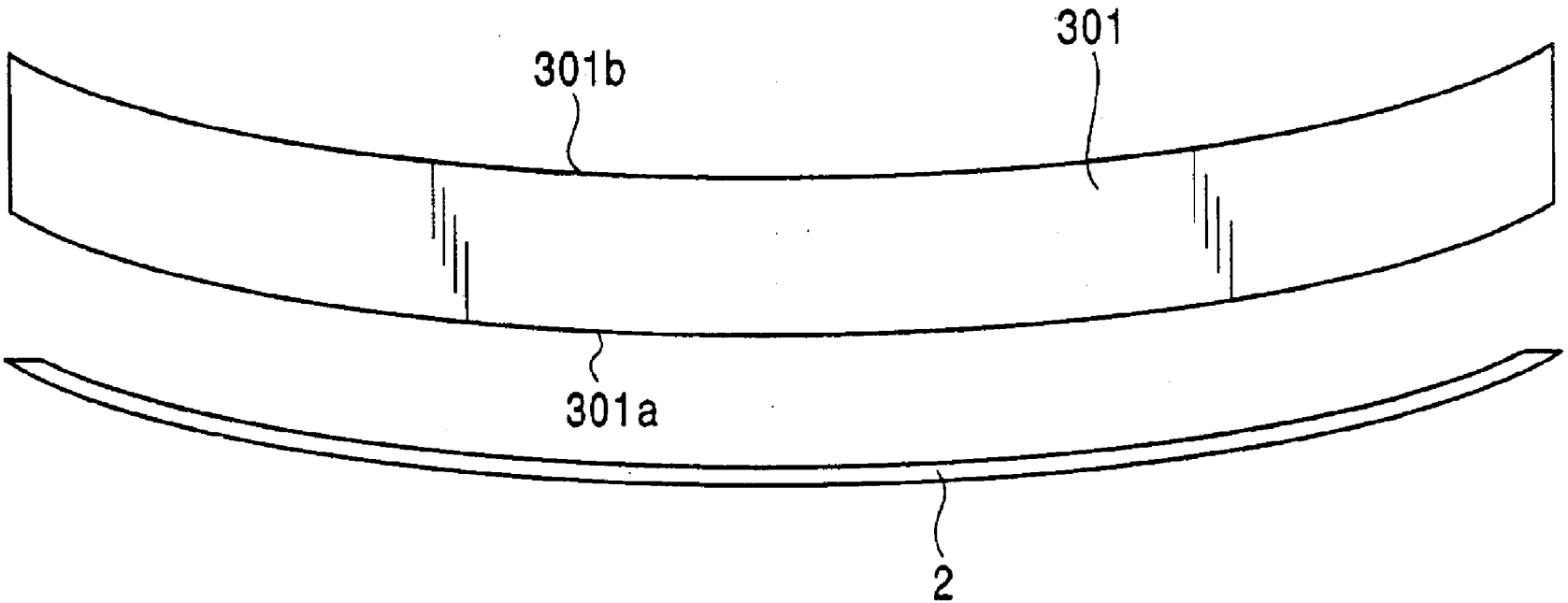
FIG. 18 is a schematic side view showing a state before a nozzle-formed member and a frame member are laminated in accordance with another example of a manufacturing method for a print head of the third embodiment.
Figure 19:
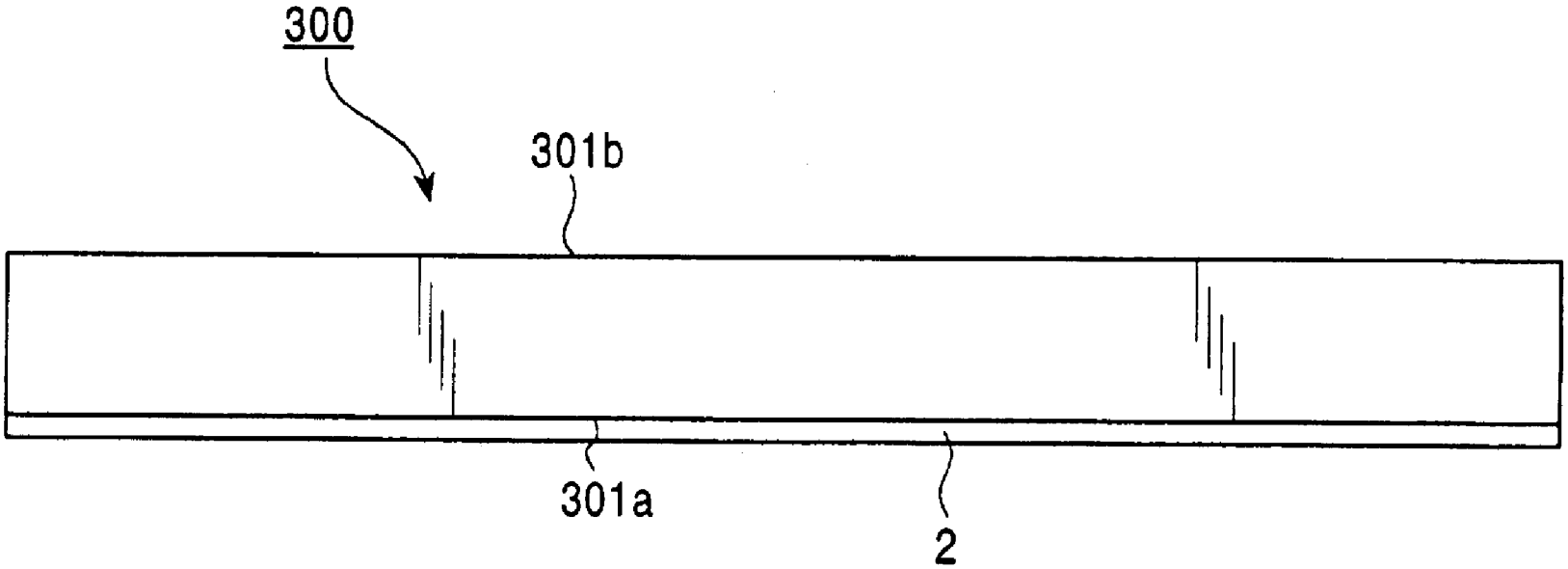
FIG. 19 is a schematic side view showing a state in which the temperature is reduced to room temperature after laminating the nozzle-formed member and the frame member.

FIGS. 18 and 19 show another example of a manufacturing method for a print head according to the third embodiment of the present invention.

First, an entire body of a head frame 301 is warped in such a manner that a lamination surface 301*a*, on which the nozzle-formed member 2 is to be laminated, becomes convex. Accordingly, a surface 301*b* at the opposite side of the lamination surface 301*a* becomes concave (see FIG. 18). The curvature of the lamination surface 301*a* is determined such that deformation of the head frame 301, which occurs at the operating temperature due to the difference in coefficients of linear expansion between the head frame 301 and the nozzle-formed member 2. can be compensated for.

Then, the nozzle-formed member 2 is laminated on the lamination surface 301*a* of the head frame 301 at a temperature higher than the operating temperature, for example, at 150° C. (see FIG. 18).

In a print head 300 which is constructed as described above, the lamination surface 301*a* of the head frame 301 deforms at the operating temperature due to a shrinking force of the nozzle-formed member 2. However, since the lamination surface 301*a* is formed so as to be convex at first, the lamination surface 301*a* becomes flat by receiving the shrinking force (see FIG. 19).

Figure 20:
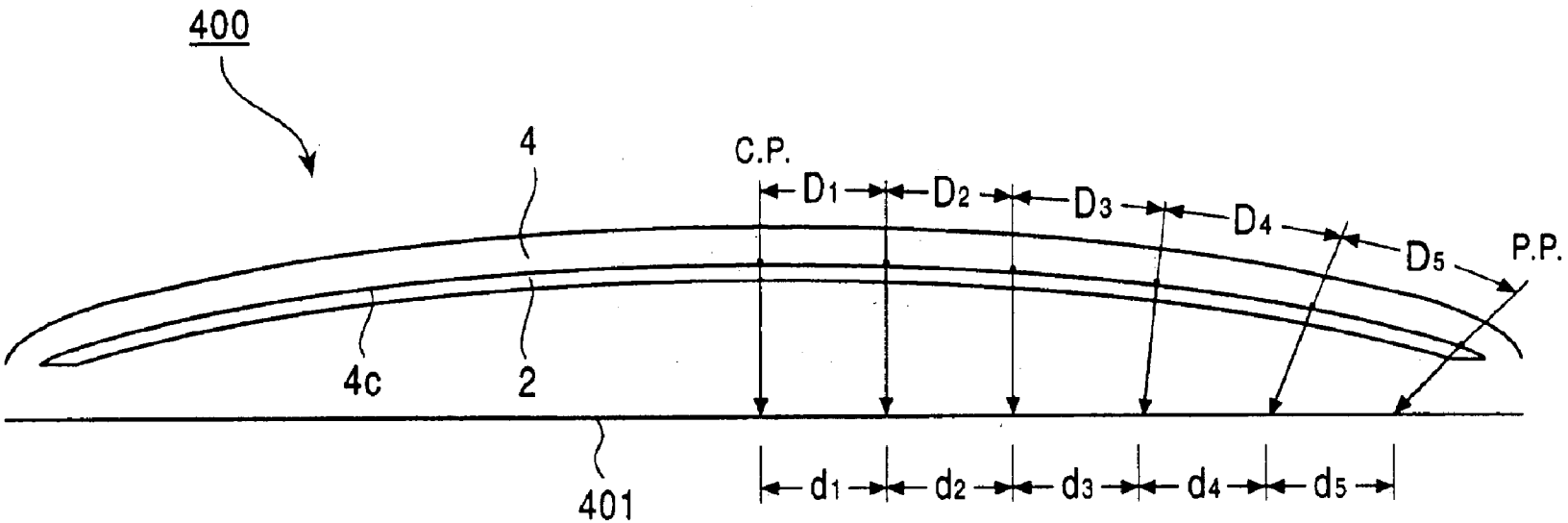
FIG. 20 is a schematic side view of a print head according to a fourth embodiment of the present invention.

FIG. 20 shows a print head according to a fourth embodiment of the present invention, and an object of the fourth embodiment is the same as that of the third embodiment.

In the print head 400, intervals D between heating elements, between ink-pressurizing cells, and between ink-ejection nozzles (in FIG. 20, positions thereof are shown by black dots for convenience) are increased from the central portion (C.P.) toward the peripheral portion (P.P.). More specifically, the relationship between the intervals can be expressed as follows:

$$D1<D2<D3<D4<D5$$

At the operating temperature, which is lower than the laminating temperature of the nozzle-formed member 2 and the head frame 4, the lamination surface 4*c* of the head frame 4 becomes concave. Thus, ejecting directions (shown by the arrows in FIG. 20) of the ink drops at positions farther from the central portion (C.P.) and closer to the peripheral-portion (P.P.) are tilted toward the center. Accordingly, intervals d between the landing points on the print medium become even from the central portion (C.P.) to the peripheral portion (P.P.), and the state shown. in FIG. 14, in which the intervals between the landing points become narrower toward the peripheral portion, can be avoided. More specifically, the relationship between the intervals between the landing points can be expressed as follows:

$$d1\approx d2\approx d3\approx d4\approx d5$$

Thus, according to the print head 400 of the fourth embodiment, degradation of the printing quality due to nonuniformity of the intervals between the landing points of the ink drops can be avoided.

Furthermore, according to a control method for a print head according to the fourth embodiment, the time to apply current to the heating elements 8 is adjusted such that the heating elements 8 positioned closer to the central portion receive current earlier than the heating elements 8 positioned closer to the peripheral portion.

When the head frame 4 warps as shown in FIG. 14, the distances between the ink-ejection nozzles 3 and the print medium k become shorter toward the peripheral portion. Thus, if all the heating elements 8 receive current at the same time, the ink drops ejected at positions closer to the central point travel for a longer time and land on the print medium later. Accordingly, as described above, the time to apply current to the heating elements 8 is adjusted such that the heating elements 8 positioned closer to the central portion receive current earlier than the heating elements 8 positioned closer to the peripheral portion. In other words, the heating elements 8 disposed at positions at which the travel time of the ink drops is longer receive current earlier, so that the ink drops are ejected earlier. Thus, the ink drops ejected by all the heating elements 8 land on the print medium at the same time. Accordingly, when the print head is applied to a line printer, printed lines become straight from the central portion to the peripheral portion, and high printing quality can be maintained.

The shapes and structures of the members of the above-described third and fourth embodiments are described merely for illustrating an example of a print head to which the present invention is applied, and are not intended to limit the scope of the present invention.

Next, a fifth embodiment of the present invention will be described below. An object of the fifth embodiment is to reduce the displacements as much as possible between the ink-pressurizing cells, which are individually provided with heating elements and the ink-ejection nozzles, which individually correspond to the ink-pressurizing cells, and to increase the rigidity of the print head.

A print head 500 according to the fifth embodiment of the present invention is a print head used in a full-color, bubble ink jet printer.

In the following descriptions of the fifth embodiment, explanations regarding the parts having the same construction as in the first embodiment are omitted, and components similar to those in the first embodiment are denoted by the same reference numerals.

The print head 500 includes a nozzle-formed member 2, in which a plurality of ink-ejection nozzles 3 are formed. Several hundred ink-ejection nozzles 3 are formed in a single substrate member, which will be described below. Also in the fifth embodiment, the nozzle-formed member 2 is formed of nickel or a material comprising nickel in the shape of, for example, a sheet having a thickness of 15 to 20 μm by an electroforming technique, and the ink-ejection nozzles 3 having a diameter of approximately 20 μm are formed in the nozzle-formed member 2 (see FIGS. 22, 23, and 24).

The nozzle-formed member 2 is laminated to a head frame 24, in which a plurality of head-chip-receiving holes 25 are formed. The head-chip-receiving holes 25 can be divided into four groups, which individually correspond to four colors. In each of the groups, head-chip-receiving holes 25 are arranged in the longitudinal direction thereof in a zigzag manner.

The head-chip-receiving holes 25 individually correspond to head chips HC, which will be described below, so that the head chips HC can be disposed therein (see FIG. 22).

In the case in which the print head 500 is applied to a line printer which prints on 'A4' sized paper in a portrait orientation, the length of each of the groups of the head-chip-receiving holes 25 corresponds to the width of the size 'A4', that is, 21 cm.

The head frame 24 is formed of a material having the same coefficient of linear expansion as a semiconductor substrate of the substrate member, which will be described below. When, for example, a silicon substrate is used as the semiconductor substrate, silicon nitride is used for forming the head frame 24. Alternatively, alumina (Al2O3), mullite, aluminum nitride, silicon carbide, etc., may be used from the group of ceramics, quartz (SiO2), etc., may be used from the group of glass, and INVAR, etc., may be used from the group of metals.

The head frame 24 may have a thickness of, for example, 5 mm, and is sufficiently rigid. When the head frame 24 is laminated on the nozzle-formed member 2 at a high temperature such as 150° C., the nozzle-formed member 2 tries to shrink by a larger amount than the head frame 24 at a temperature lower than the laminating temperature (150° C.), and thus becomes tense. Since the head frame 24 is sufficiently rigid, the interval between the ink-ejection nozzles 3, that is, a nozzle interval, varies in accordance with the coefficient of linear expansion of the head frame 24. The head frame 24 is laminated on the nozzle-formed member 2 by using, for example, a heat-setting adhesive sheet.

A plurality of head chips HC are formed by laminating substrate members 6 on the nozzle-formed member 2. Accordingly, a plurality of head chips HC are formed on a single nozzle-formed member (see FIG. 22).

In the fifth embodiment, the substrate members 6 are the same as those in the first embodiment, and explanations thereof are thus omitted.

As in the above-described embodiments, the thickness of the barrier layer 10 is approximately 12 μm, and the heating elements 8 have a square shape of which the length of each side is approximately 18 μm. In addition, the width of the ink-pressurizing cells 9 is approximately 25 μm.

As an example, a case is considered in which the print head 500 is applied to a line printer which prints on 'A4' sized paper in a portrait orientation. In such a case, for a single group of head-chip-receiving holes 25 formed in the head frame 24, approximately five thousand ink-ejection nozzles 3 are formed in the nozzle-formed member 2 and sixteen substrate members 6 are laminated thereon. Since is impossible to show the accurate numbers of ink-ejection nozzles 3 with accurate dimensions in the drawings which are limited in size, the drawings are partly exaggerated and elements are sometimes omitted in order to facilitate understanding.

Because of the reason described above in the first embodiment, the head frame 24 and the nozzle-formed member 2 are laminated together at 150°, and then the substrate members 6 are laminated to the nozzle-formed member 2 at approximately 105°.

Figure 21:
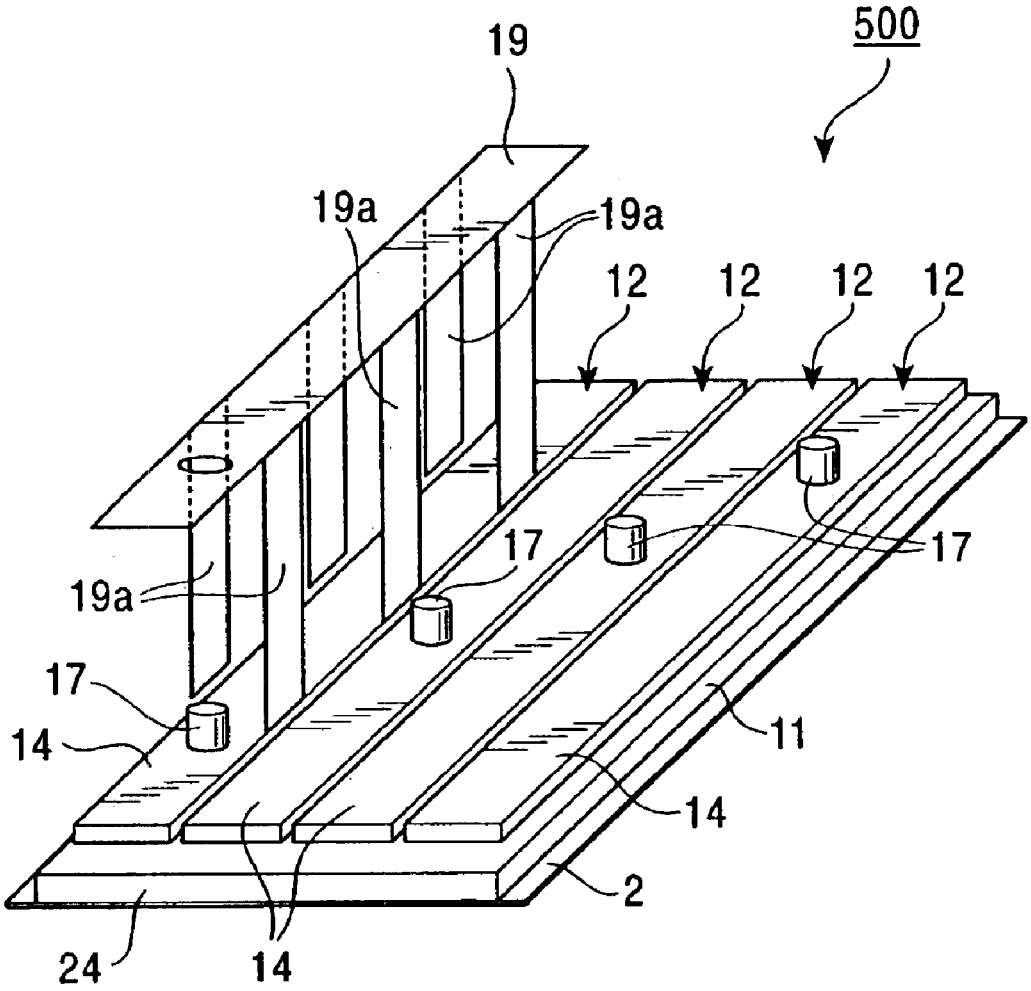
FIG. 21 is a perspective view of a print head according to a fifth embodiment of the present invention.

Accordingly, a head unit 11 is formed by combining the head frame 24, the nozzle-formed member 2, and the substrate members 6, and ink-passage plates 12 are then attached to the head unit 11 (see FIG. 21).

Figure 22:
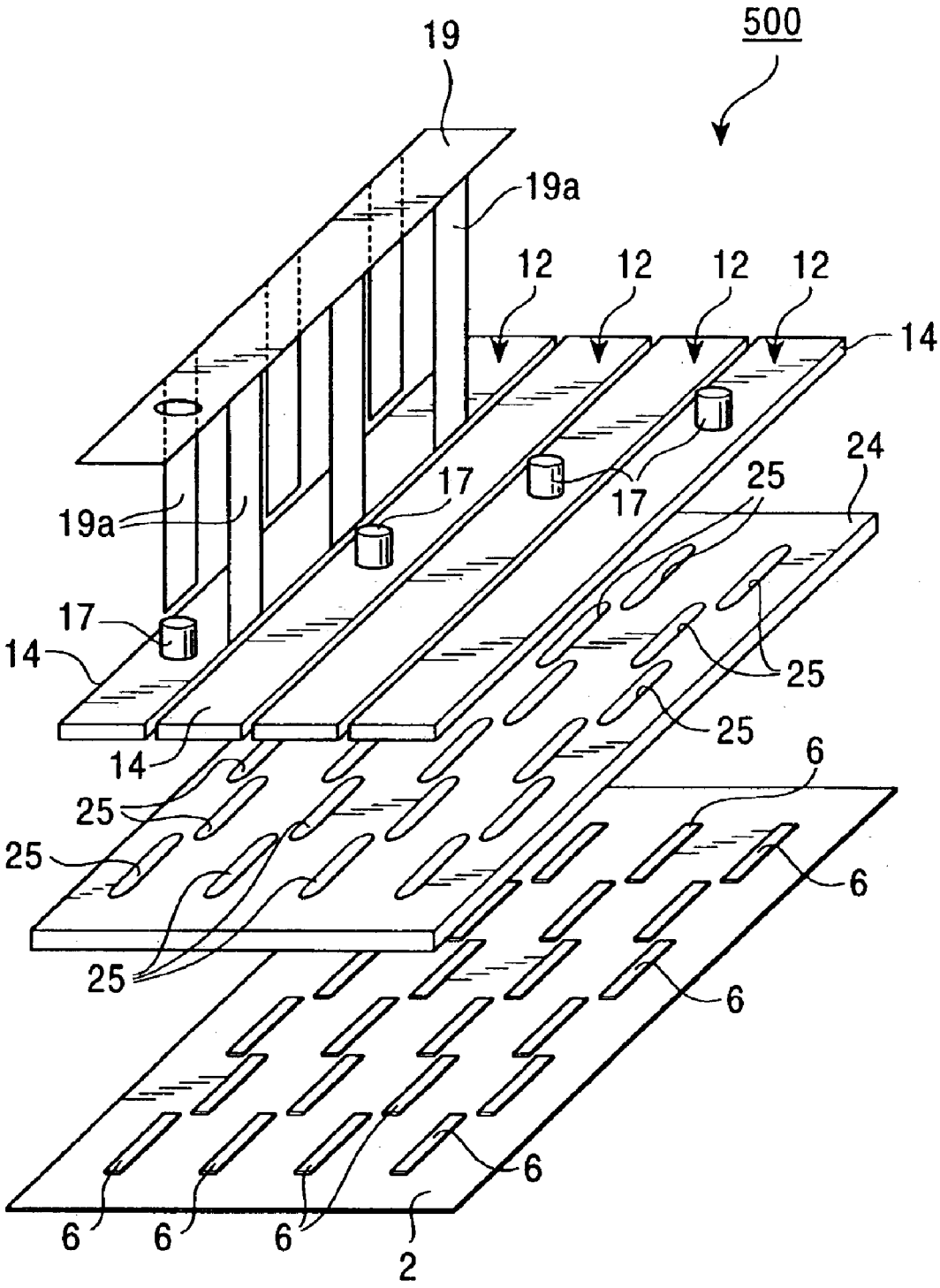
FIG. 22 is an exploded perspective view of the print head according to the fifth embodiment.

One ink-passage plate 12 is provided for one color, and four ink-passage plates 12 individually corresponding to four colors are provided in total (see FIGS. 21 and 22). The ink-passage plates 12 are formed of a material which does not easily deform and which has ink resistance.

Figure 23:
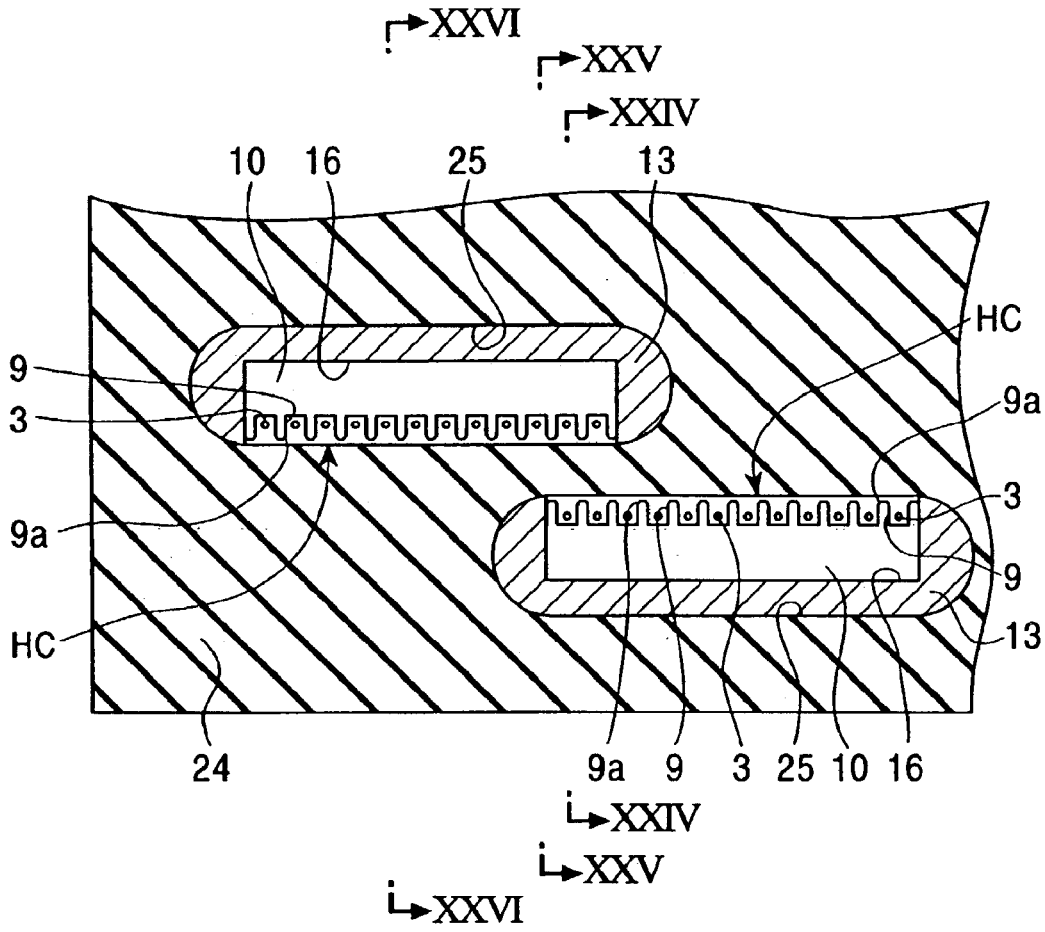
FIG. 23 is a sectional view of FIG. 22 showing an important part of the print head according to the fifth embodiment; according to the fifth embodiment.
Figure 24:
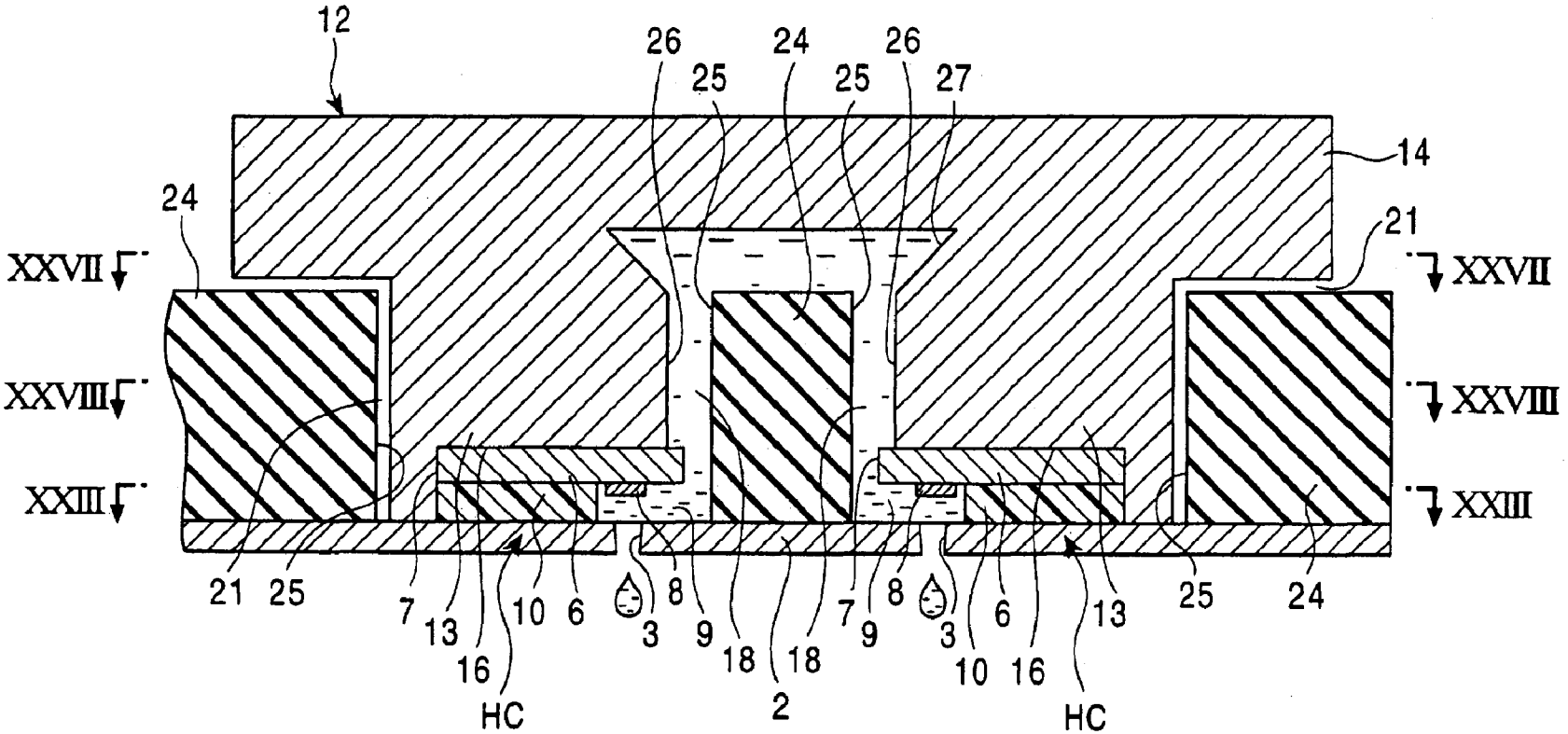
FIG. 24 is a sectional view of FIG. 23 cut along line XXIV—XXIV.

As shown in FIG. 24, each of the ink-passage plates 12 includes a flange portion 14 having the shape like a plate of which the size is larger than a region including the head-chip-receiving holes 25, and chamber portions 13 which protrude from one side of the flange portion 14. FIG. 24 shows a sectional view of FIG. 23 cut along line XXIV—XXIV at a part including two head-chip-receiving holes 25.

As shown in FIG. 24, the size of the chamber portions 13 is determined such that they can be individually fitted inside the head-chip-receiving holes 25, and that concavities 26 are formed so that there are clearances in the head-chip-receiving holes 25. Each of the concavities 26 forms an ink passage 18, which-will be described below.

The chamber portions 13 are individually provided with notches 16 at the edge thereof. The notches 16 are connected to the concavities 26, and are large enough that the substrate members 6 can be fitted therein.

More specifically, the notches 16 are formed in two rows in a zigzag manner so that the concavities 26 oppose one another and end portions of the notches overlap one another in the direction in which they are arranged.

In addition, the flange portion 14 of the ink-passage plate 12 is provided with an ink-supply passage 27 which extends in the longitudinal direction of the flange portion 14 at the midsection thereof. The ink-supply passage 27 is connected to the concavities 26 formed in the chamber portions 13.

The flange portion 14 of the ink-passage plate 12 is also provided with an ink-supply tube 17, which projects from the side opposite to the side at which the chamber portions 13 are formed, and which is connected to the above-described ink-supply passage 27 (see FIGS. 21, 22, and 24).

Figure 25:
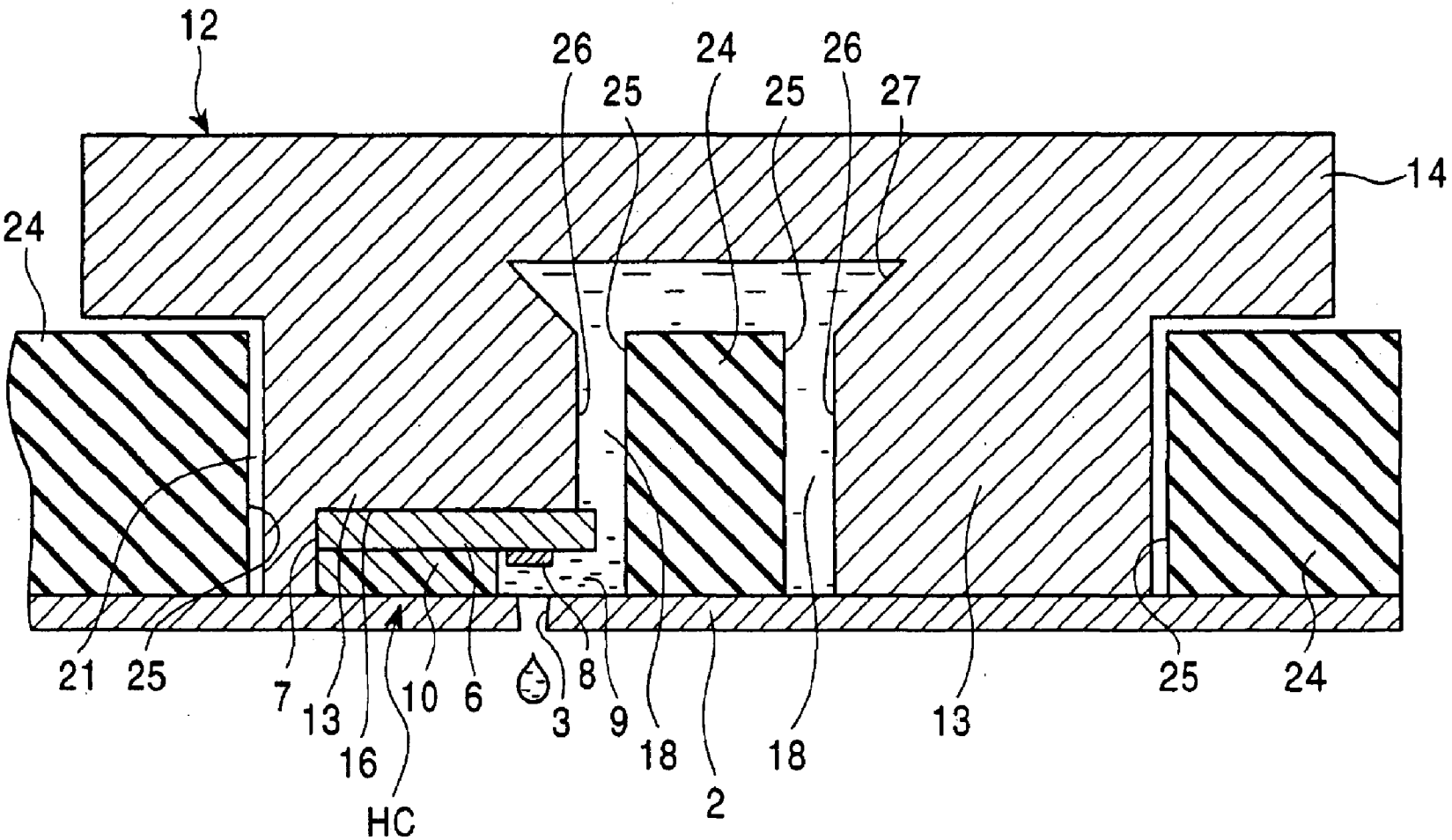
FIG. 25 is a sectional view of FIG. 23 cut along line XXV—XXV.
Figure 26:
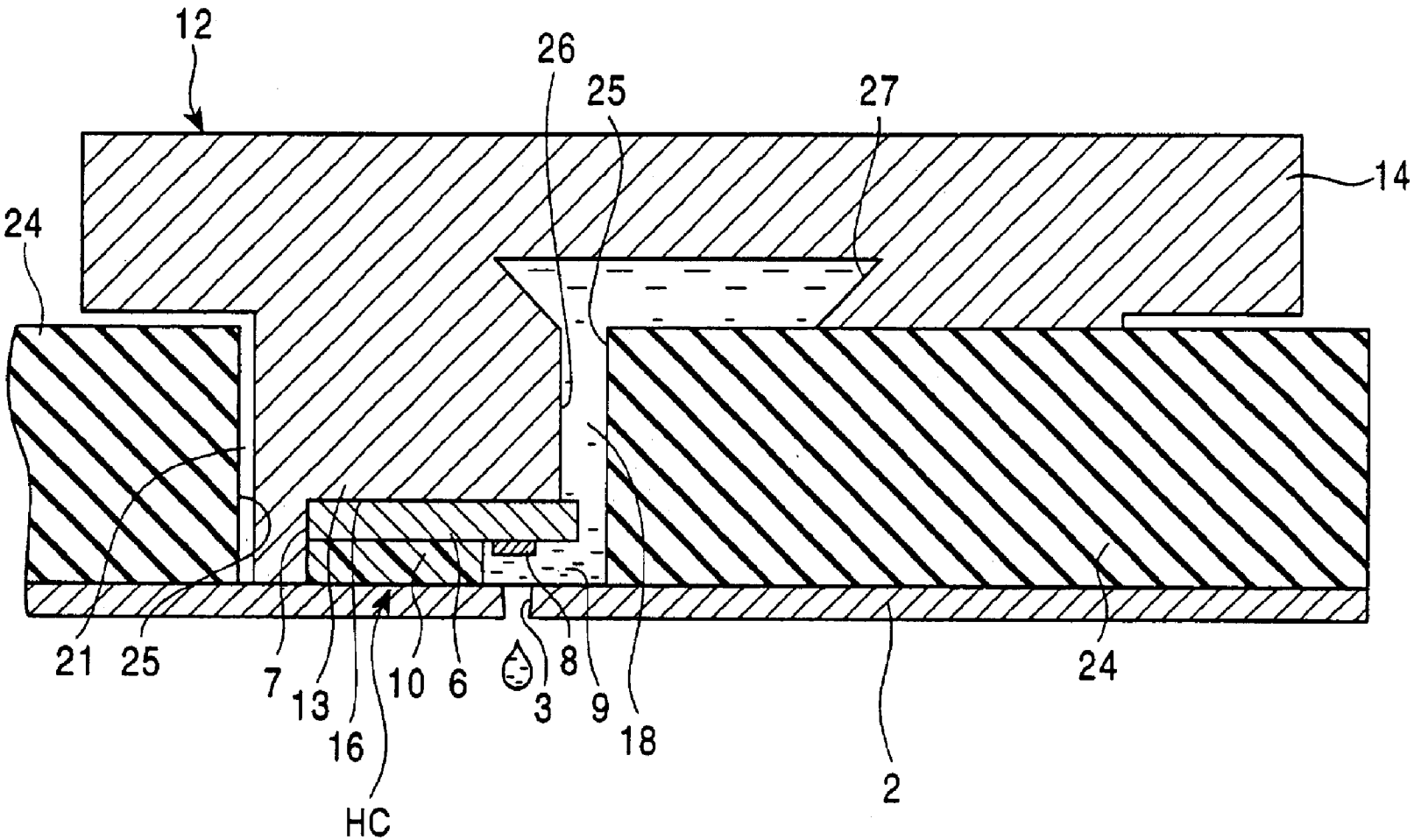
FIG. 26 is a sectional view of FIG. 23 cut along line XXVI—XXVI.

Each of the ink-passage plates 12 is adhered to the head frame 24 in such a manner that the chamber portions 13 are fitted into the head-chip-receiving holes 25 formed in the head frame 24 and the flange portion 14 contacts the head frame 24 (see FIGS. 25 and 26). FIG. 25 is a sectional view of FIG. 23 cut along line XXV—XXV, and FIG. 26 is a sectional view of FIG. 23 cut along line XXVI—XXVI. The flange portion 14 contacts the head frame 24 at position shown in FIG. 26.

In addition, the substrate members 6 laminated on the nozzle-formed member 2 are positioned inside the notches 16 formed in the chamber portions 13 and are adhered to the chamber portions 13 (see FIGS. 23 and 24).

By combining the ink-passage plates 12 with the head unit 11 as described above, closed spaces surrounded by the chamber portions 13 of the ink-passage plates 12 and the nozzle-formed member 2 are formed. These closed spaces include ink-supply passages 27, the concavities 26, and the ink passages 18, and are connected to the exterior environment only through the ink-supply tubes 17. Ink which is supplied through the ink-supply passages 27 is transferred through the ink passages 18 to each of the ink-pressurizing cells 9.

Figure 27:
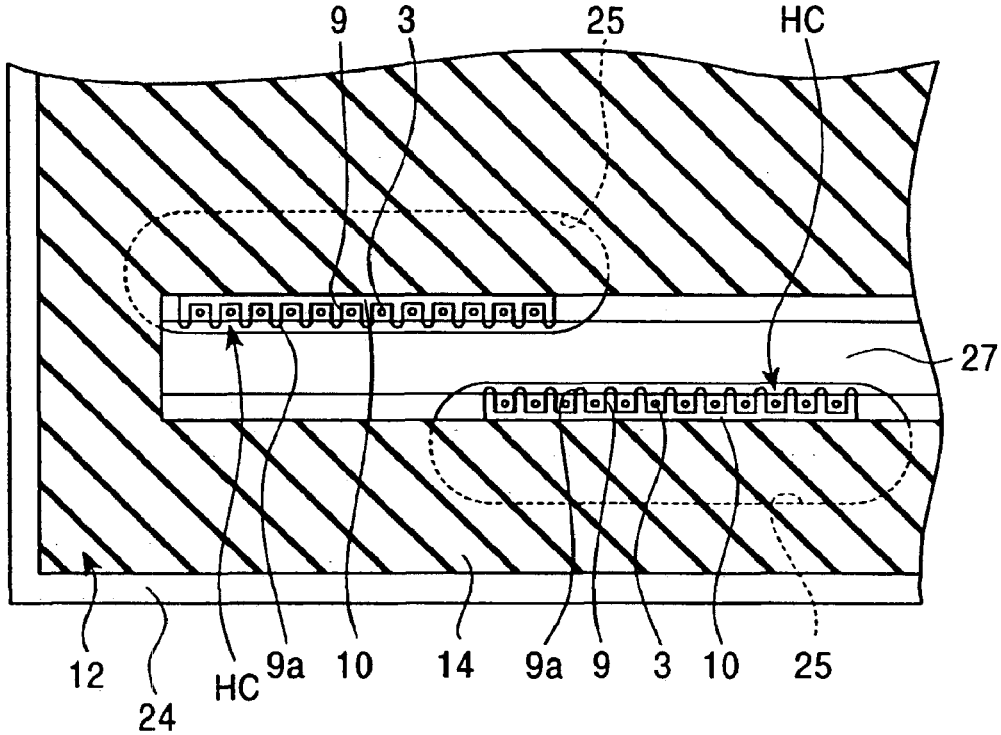
FIG. 27 is a sectional view of FIG. 24 cut along line XXVII—XXVII.
Figure 28:
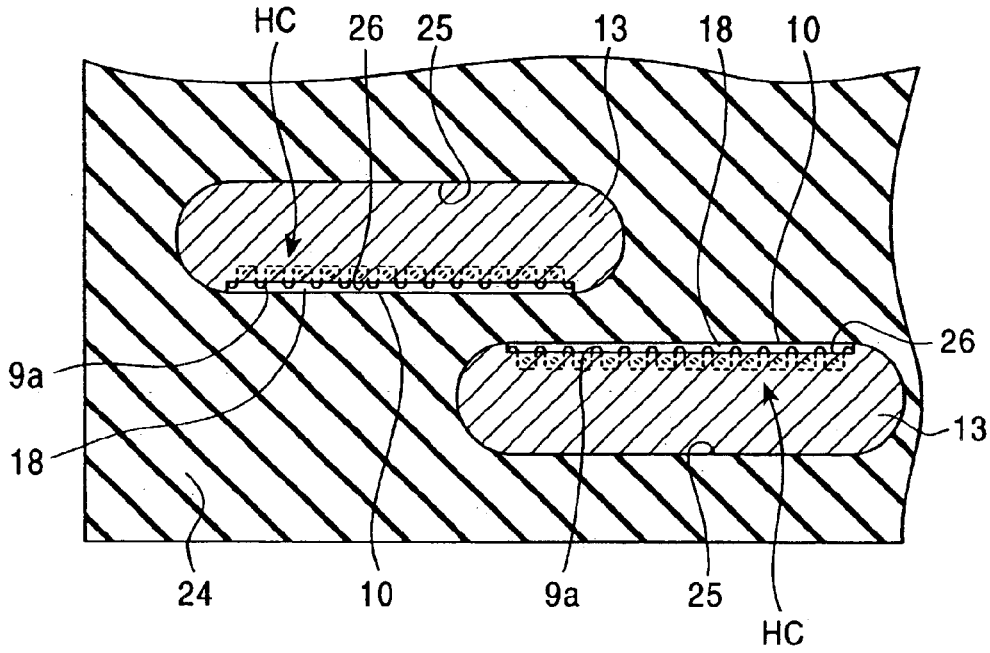
FIG. 28 is a sectional view of FIG. 24 cut along line XXVIII—XXVIII.

Although the head chips HC are individually provided with the ink passages 18, a single ink-supply passage 27 is connected to a plurality of ink passages 18 (see FIGS. 24, 25, and 26). Thus, the structure for supplying ink is made simpler than a print head in which the ink-supply passages 27 are individually provided with ink passages. This construction is shown in FIGS. 27 and 28. FIG. 27 is a sectional view of FIG. 24 cut along line XXVII—XXVII. As shown in FIG. 27, the head-chip-receiving holes 25 are arranged across the ink-supply passage 27. FIG. 28 is a sectional view of FIG. 24 cut along line XXVIII—XXVIII. As shown in FIG. 28, the head-chip-receiving holes 25 are individually provided with the ink-passages 18.

Four flexible substrates 19, which electrically connect the heating elements 8 formed in the substrate members 6 to an exterior control unit, are individually provided for four colors (only one of them is shown in FIG. 22). Each of the flexible substrates 19 is provided with connecting tabs 19*a*, which are inserted through openings 20 formed between the head frame 4 and the ink-passage plates 12 (see FIG. 24), and extend to the substrate members 6. The connecting tabs 19*a* are electrically connected to contact points (not shown), which-are individually connected to the heating elements 8 formed in the substrate members 6.

The ink-supply tubes 17 provided on the ink-passage plates 12 are individually connected to ink tanks (not shown), which individually contain inks of different colors, and the ink-supply passages 27, the ink passages 18, and the ink-pressurizing cells 9 are filled with ink supplied from the ink tanks.

When a current pulse is applied for a short time such as 1 to 3 $\mu$s to some of the heating elements 8 selected in accordance with a command issued by the control unit of the printer, the corresponding heating elements 8 are rapidly heated. Accordingly, at each of the corresponding heating elements 8, a bubble of ink vapor (ink bubble) is generated at the surface thereof. Then, as the ink bubble expands, a certain volume of ink is pushed ahead, and the same volume of ink is ejected out from the corresponding ink-ejection nozzle 3 as an ink drop. The ink drop, which is ejected from the ink-ejection nozzle h, adheres (lands on) to a print medium such as a piece of paper, etc. Then, the ink-pressurizing cells 9 from which the ink drops are ejected are immediately refilled with ink through the ink passages 18 by the same amount as the ejected ink drops.

The manufacturing process of the above-described print head 500 will be briefly explained below with reference to FIGS. 29 to 33.

Figure 29:
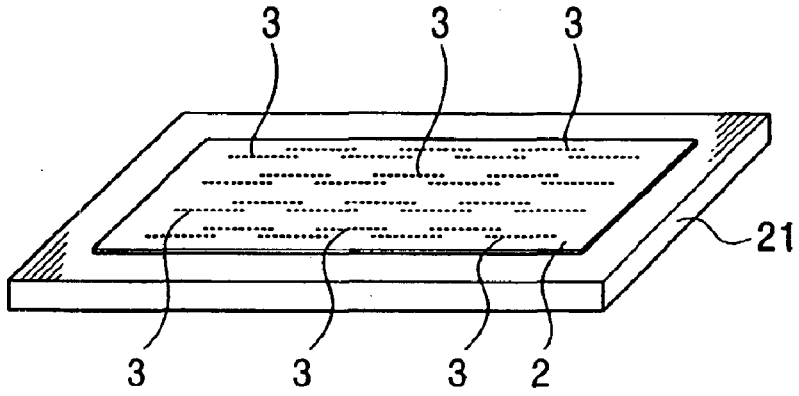
FIG. 29 is a perspective view showing a state in which a nozzle-formed member of a print head according to the fifth embodiment.

First, the nozzle-formed member 2 is formed by an electroforming technique, and is disposed on a supporting jig 21 having a flat surface (see FIG. 29). The reason why the nozzle-formed member 2 is disposed on the supporting jig 21 is because the nozzle-formed member 2 is extremely thin and it cannot maintain its shape by itself.

Figure 30:
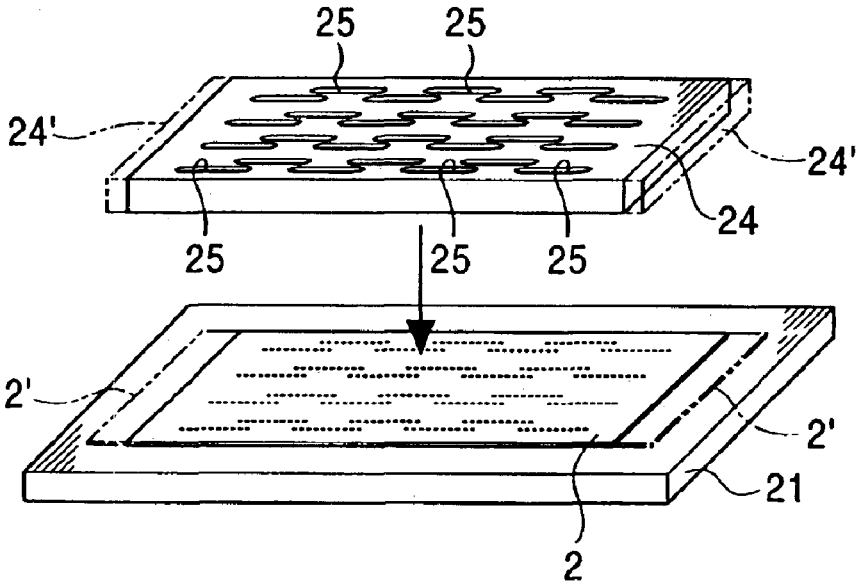
FIG. 30 shows a step of combining a head frame and a nozzle-formed member in the manufacturing process of the print head according to the fifth embodiment.

Next, the head frame 24 is laminated on the nozzle-formed member 2 disposed on the supporting jig 21 by heating a heat-setting adhesive sheet, for example, an epoxy adhesive sheet, at 150° C. (see FIG. 30). In FIG. 30, reference numerals 2' and 24' schematically show the shapes of the nozzle-formed member 2 and the head frame 24 which extend by being heated to 150° C.

Figure 31:
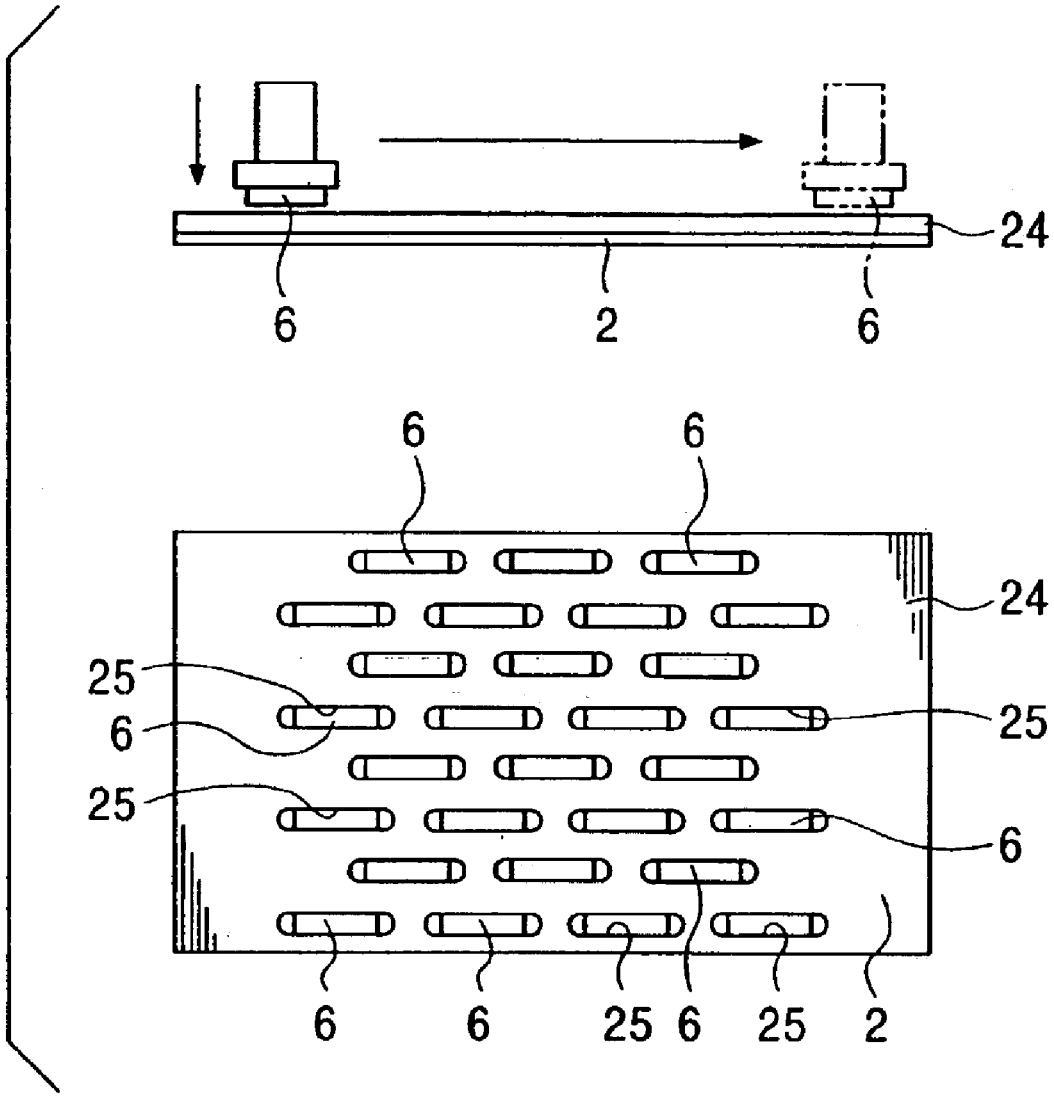
FIG. 31 is a schematic representation showing a step of combining substrate members and the nozzle-formed member in the manufacturing process of the print head according to the fifth embodiment.
Figure 32:
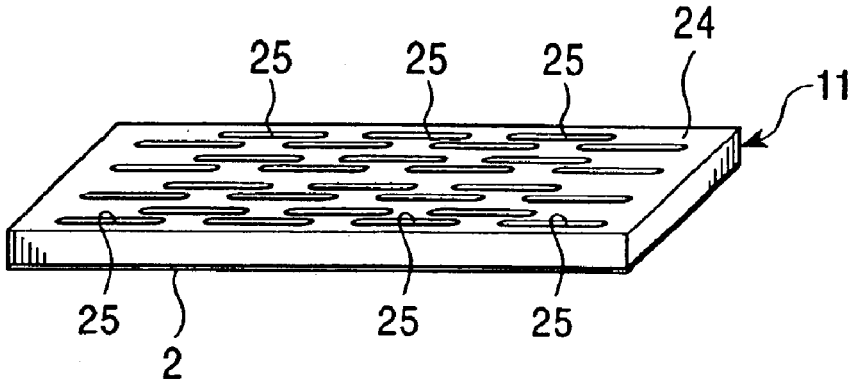
FIG. 32 is a schematic representation showing a head unit which is constructed by combining the head frame, the nozzle-formed member, and the substrate members in the manufacturing process of the print head according to the first embodiment.

Next, the supporting jig 21 is removed, and the substrate members 6 are laminated on the nozzle-formed member 2 at 105° C., so that the head chips HC are formed (see FIG. 31). FIG. 31 only schematically shows the laminating step, and only seven substrate members 6 are shown for each color.

Figure 33:
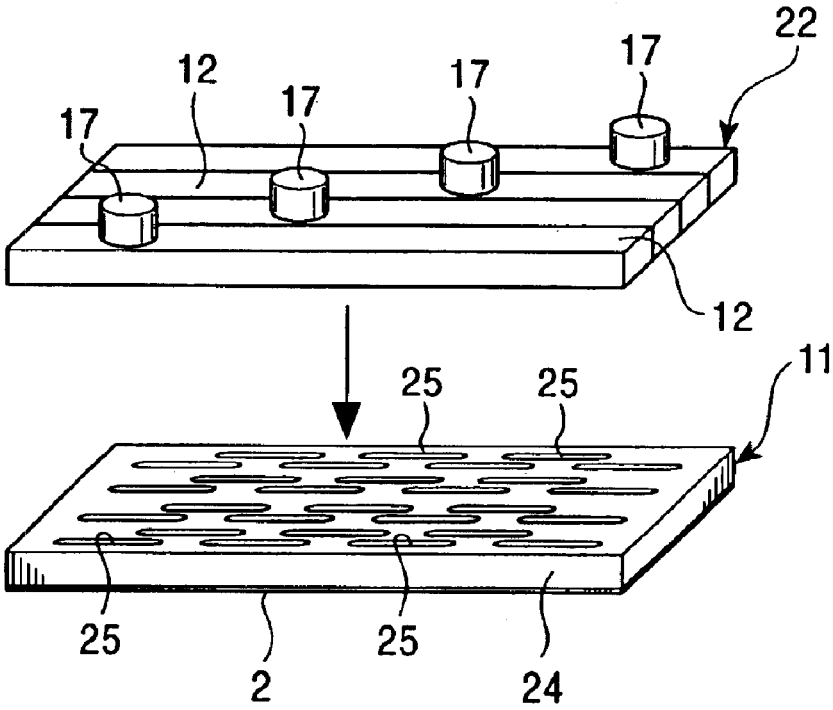
FIG. 33 is a schematic representation showing a step of combining the head unit and an ink-passage unit in the manufacturing process of the print head according to the fifth embodiment.
Figure 34:
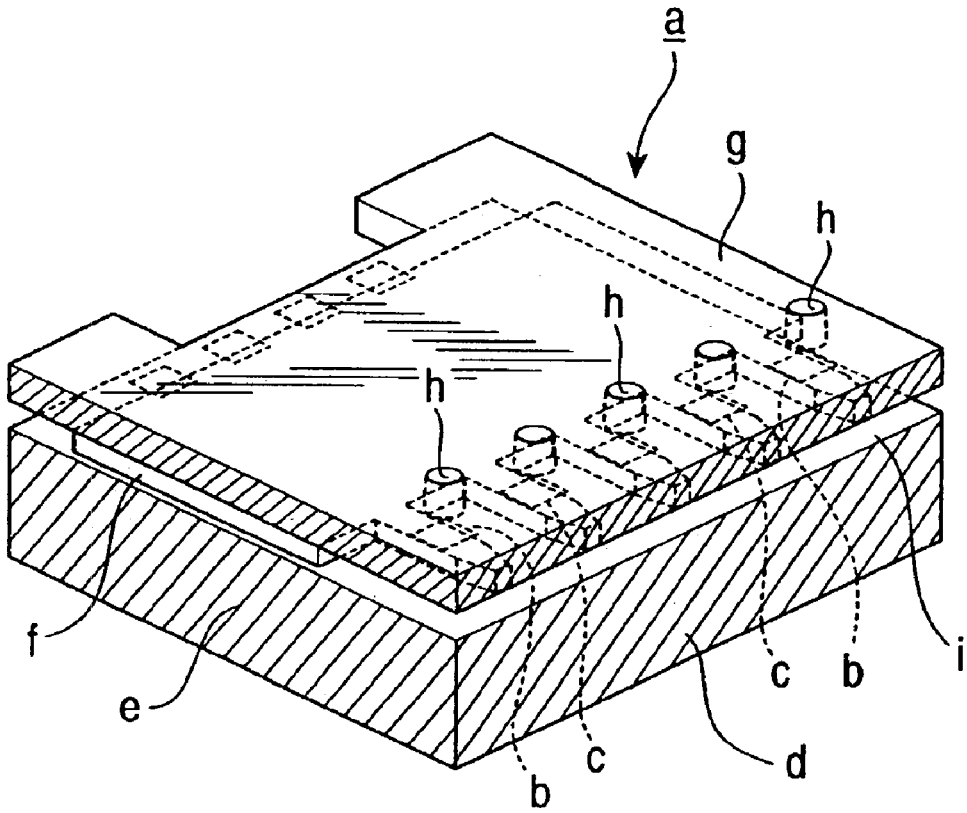
FIG. 34 is a perspective view of a conventional print head.
Figure 35:
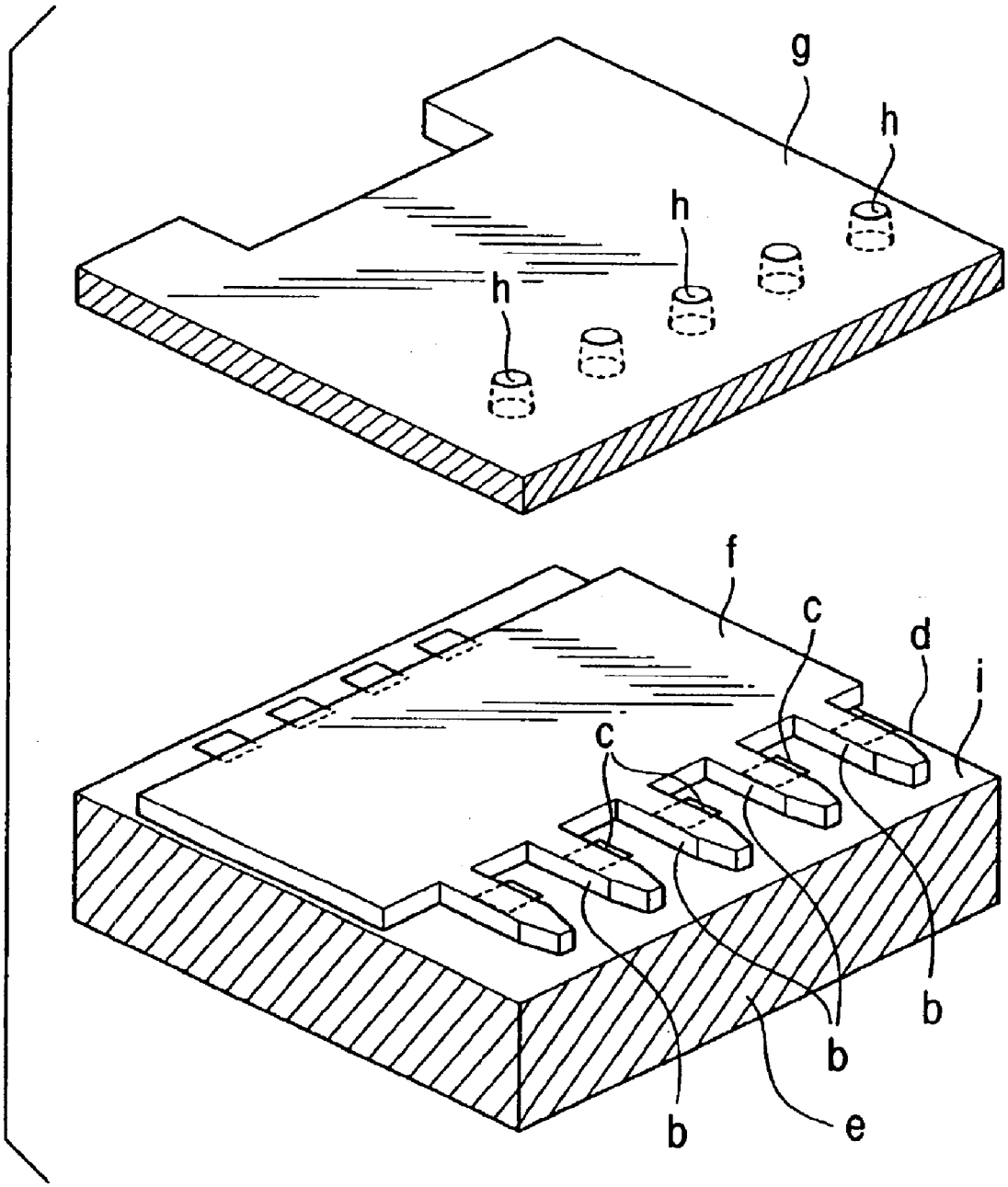
FIG. 35 is an exploded perspective view of the conventional print head.
Figure 36:
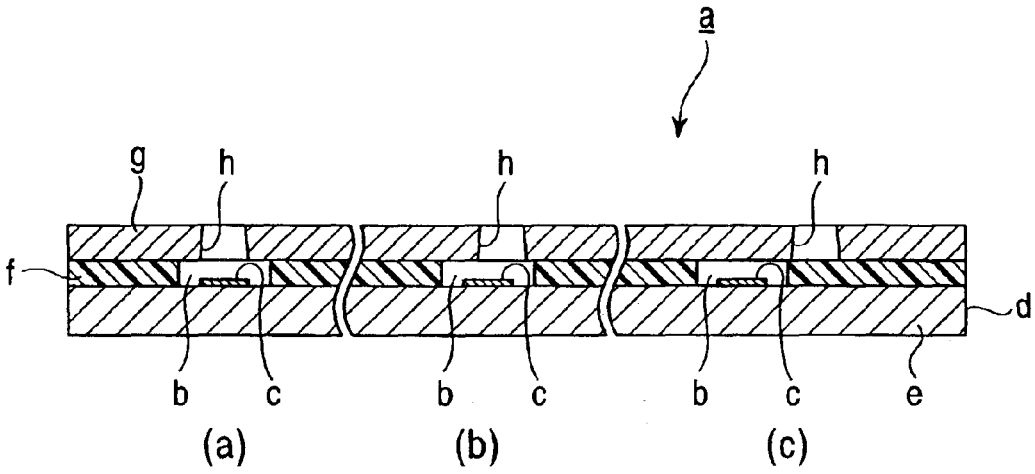
FIG. 36 is a sectional view showing a problem of the conventional print head.

Accordingly, the head unit 11 is completed (see FIG. 32), and an ink-passage unit 22, which is constructed by another process, is attached to the head unit 11 (see FIG. 33). The ink-passage unit 22 is constructed by combining the above-described four ink-passage plates 12 using a connecting member (not shown).

In the print head 500, the head frame 24, which has approximately the same coefficient of linear expansion as that of the semiconductor substrates 7 (for example, silicon substrates) which are the base substrates of the substrate members 6, is first laminated on the nozzle-formed member 2. Then, the substrate members 6 are laminated on the nozzle-formed member 2 at a temperature lower than the laminating temperature of the head frame 24 and the nozzle-formed member 2. Accordingly, the interval between the ink-ejection nozzles 3 formed in the nozzle-formed member 2 and the interval between the heating elements 8 formed in the substrate members 6 are always the same at temperatures lower than the laminating temperature of the nozzle-formed member 2 and the head frame 24. Thus, a print head having improved characteristics of ink drop ejection can be obtained. Even when the size of the substrate members 6 and the numbers of heating elements 8 and the ink-ejection nozzles 3 provided for a single substrate member 6 are increased, displacements between the exothermic elements 8 and the ink-discharge nozzles 3 do not easily occur. Accordingly, the size of the print head 500 can be easily increased, and thus the print head 500 is especially suitable for long print heads such as print heads for line printers, etc.

Since the head frame 24 is provided with a plurality of head-chip-receiving holes 25 which extend in the longitudinal direction thereof, the head frame 24 is rigid in the longitudinal direction. Accordingly, by laminating the head frame 24 on the nozzle-formed member 2, the nozzle-formed member 2 obtains high rigidity. Thus, as described above, it is possible to form a print head for a line printer in which four print heads for four colors are combined.

Furthermore, since the head chips HC are disposed in a zigzag manner in the above-described print head, even when head chips HC having different printing characteristics are arranged, print mottling can be made less conspicuous. In addition, since a plurality of head chips HC are formed on a single nozzle-formed member, positional accuracy of the ink-ejection nozzles can be increased and the printing characteristics can be improved.

The above-described print head 500 is suitable as a print head that is long in a direction perpendicular to the feed direction of a print medium, and is especially suitable as a line head. Accordingly, print speed can be increased.

Although the present invention was applied to a print head for a full-color, bubble ink jet printer in the above-described embodiment, the present invention may also be applied to print heads for monocolor printers. In addition, even in the case in which the present invention is applied to a print head for a full-color printer, the present invention is not limited to the above-described structure in which the four print heads for four colors are combined, and an individual print head may be prepared for each color.

The shapes and structure of the members of the above-described fifth embodiment are described merely for illustrating an example of a print head to which the present invention is applied, and are not intended to limit the scope of the present invention.

What is claimed is:

1. A print head having ink-pressurizing cells, heating elements, and ink-ejection nozzles, the print head comprising:

a substrate member which forms side surfaces and one end surface of the ink-pressurizing cells and which is provided with the heating elements;

a nozzle-formed member which forms the other end surface of the ink-pressurizing cells, and in which the ink-ejection nozzles, which individually correspond to the ink-pressurizing cells, are formed;

a head frame which supports the nozzle-formed member; and a plurality of substrate units, each of which includes a plurality of substrate members, are provided for individually ejecting inks of different colors, and wherein the substrate members included in the substrate units are attached to a single nozzle-formed member.

2. A print head according to claim 1, wherein a plurality of substrate units, each of which includes one or more substrate members, are provided for individually ejecting inks of different colors, and wherein the substrate members included in the substrate units are attached to a single nozzle-formed member.

3. A print head according to claim 1, wherein the print head is a line head.

4. A print head according to claim 1, wherein the nozzle-formed member is formed of a material comprising nickel.

* * * * *